US006076271A

United States Patent [19]

Kobayashi et al.

[11] Patent Number: 6,076,271

[45] Date of Patent: Jun. 20, 2000

[54] GARBAGE DISPOSER

[75] Inventors: Toshihiro Kobayashi; Katsusuke Ishiguro, both of Nagoya, Japan

[73] Assignee: Paloma Industries, Ltd., Nagoya, Japan

[21] Appl. No.: 09/207,265

[22] Filed: Dec. 9, 1998

[30] Foreign Application Priority Data

| | | | |
|---|---|---|---|
| Dec. 16, 1997 | [JP] | Japan | 9-364051 |
| Dec. 17, 1997 | [JP] | Japan | 9-364675 |
| Jun. 16, 1998 | [JP] | Japan | 10-168423 |

[51] Int. Cl.[7] ..... F26B 21/06

[52] U.S. Cl. ..... 34/77; 34/79; 34/219; 34/226; 34/227

[58] Field of Search ..... 34/257, 259, 265, 34/469, 74, 76, 77, 79, 84, 85, 86, 201, 202, 218, 219, 226, 227, 203, 199; 219/679, 680, 683, 685, 686, 710

[56] References Cited

U.S. PATENT DOCUMENTS

| | | | |
|---|---|---|---|
| 1,525,131 | 2/1925 | Hitchcock . | |
| 1,634,931 | 7/1927 | Cole . | |
| 4,154,003 | 5/1979 | Muller . | |
| 4,204,339 | 5/1980 | Muller . | |
| 4,447,965 | 5/1984 | Bray | 34/416 |
| 5,174,042 | 12/1992 | Tomizawa et al. | 34/259 |
| 5,353,519 | 10/1994 | Kanamaru et al. | 34/92 |

FOREIGN PATENT DOCUMENTS

| | | |
|---|---|---|
| 0 860 407 A2 | 8/1998 | European Pat. Off. . |
| 980759 | 5/1951 | France . |
| 91 00 341 | 12/1991 | Germany . |
| 295 06 049 U | 6/1995 | Germany . |
| 5-146773 | 6/1993 | Japan . |
| 5-185060 | 7/1993 | Japan . |
| 8-014750 | 1/1996 | Japan . |
| 8-14750 | 1/1996 | Japan . |
| 8-200953 | 8/1996 | Japan . |
| 8-299943 | 11/1996 | Japan . |
| 10-165924 | 6/1998 | Japan . |
| 262866 | 11/1949 | Switzerland . |
| WO 92/02772 | 2/1992 | WIPO . |
| WO 96/17796 | 6/1996 | WIPO . |

*Primary Examiner*—Pamela A. Wilson
*Attorney, Agent, or Firm*—Oliff & Berridge, PLC

[57] ABSTRACT

A garbage disposer for deodorizing and drying of garbage. A processing tank containing garbage is heated through the implementation of a heater, and thereby the temperatures in the processing tank and the heating chamber are raised and the water contained in the garbage is evaporated. When a predetermined period of time has passed, from the start of the heating of the processing tank, a fan and heater are prompted into operation and the gas in the heating chamber, which contains a large quantity of steam, flows into a condensing section where the gas is cooled as it flows through the fin tube and the dew point of the gas is lowered; and the steam contained in the gas is condensed into water. The remaining gas is then returned to the heating chamber through a returning pipe, where the gas is heated to a high temperature. The condensed water is collected in a condensing section and the collected water flows into a discharge pipe whereby the water is discharged to the outside of the garbage disposal. The high temperature gas flows to a nozzle where it is jetted through the nozzle and to the garbage contained within the processing tank.

10 Claims, 12 Drawing Sheets

GARBAGE DISPOSER

BACKGROUND OF THE INVENTION

The present invention relates to a garbage disposer. More particularly, the present invention relates to a garbage disposer handily used for deodorizing and drying garbage generated in the kitchen of a common home, restaurant, school or hospital.

Conventionally, there is provided a garbage disposer by which garbage is dried so that it can be prevented from decaying and deodorized for the prevention of an offensive smell generated in the process of disposing the garbage. In general, this garbage disposer is composed in such a manner that steam generated in the process of heating the garbage is deodorized and discharged outside the garbage disposer.

For example, the Unexamined Japanese Patent Application Publication No. Hei 5-146773 discloses a garbage heating and drying device, which is composed as follows. There is provided a rotary container made of heat insulating material into which garbage is charged. While the rotary container is inclined and rotated, garbage in the rotary container is heated. Steam generated from garbage is guided into a condensing section communicated with the atmosphere. When steam is condensed in the condensing section, garbage is dried.

According to the garbage heating and drying device disclosed in the Unexamined Japanese Patent Application Publication No. Hei 5-146773, garbage is heated while the rotary container, which is inclined, is being rotated. Therefore, no garbage is locally heated, and it is possible to reduce the generation of an offensive smell caused by thermal decomposition of garbage.

However, the garbage heating and drying device disclosed in the above patent publication has the following disadvantages. Since garbage is dried in the atmospheric pressure in the above the garbage heating and drying device, it is necessary to raise the drying temperature so that garbage can be dried in a short period of time. Therefore, the energy cost is increased. Further, when the garbage heating and drying device is used in a room, the room temperature is raised by heat generated from the heat source of the device. Furthermore, in order to prevent garbage from heating locally, it is necessary to provide a rotating mechanism for rotating the rotary container. Accordingly, the device becomes complicated.

Garbage is mainly produced in the kitchen. Therefore, it is convenient to arrange and use a garbage disposer in- the kitchen. However, when the garbage disposer is arranged in the kitchen, various problems are caused and the environment is deteriorated in the kitchen, for example, an offensive smell leaks and humidity in the kitchen is raised when steam is discharged from the garbage disposer, and further temperature in the kitchen is raised by the influence of a heat source incorporated into the garbage disposer. For the above reasons, it is difficult to arrange the garbage disposer in the kitchen. Therefore, the present applicant previously proposed an invention of a garbage disposer characterized as follows. The garbage disposer includes a heating chamber for heating garbage and a condensing chamber for cooling and condensing steam. A space, which communicates the heating chamber with the condensing chamber, is tightly closed under the condition that air is purged from this space by steam generated when garbage is heated. Pressure in this tightly closed space is made negative by increasing a quantity of condensed water, so that garbage can be dried. When the above arrangement is adopted, it is possible to prevent an offensive smell from leaking out from a gap between the cover and the seal by the effect of negative pressure, and at the same time the boiling point can be lowered and an intensity of energy necessary for heating garbage can be decreased. Further, when offensive smell components generated from garbage are discharged into a drainpipe together with condensed water, the offensive smell and steam are not discharged from the garbage disposer. Therefore, this type garbage disposer can be used in the kitchen.

According to the above arrangement, since air is pushed out from the space by the action of steam, gas filling the space is mainly composed of steam. Due to the foregoing, a coefficient of volumetric contraction can be enhanced when gas is cooled in the condensing chamber. Accordingly, steam generated in the heating chamber can be made to flow into the condensing chamber smoothly. However, from an actual view point, it is difficult to enhance the degree of vacuum because the handling and the structure become complicated and further the equipment cost is raised. Therefore, it is considered that a considerably large quantity of air still exists in the tightly closed space. Accordingly, air remains as it is in the condensing chamber after cooling. The thus remaining air obstructs the flow of steam from the heating chamber into the condensing chamber. Consequently, the steam generating efficiency in the heating chamber is deteriorated. As a result, it is impossible to provide a high drying performance.

In the arrangement described above, the following problems may be encountered. It is important to effectively condense steam generated from garbage. However, in order to enhance the cooling efficiency, the above arrangement has a cooling structure for cooling steam by sending a blast of air from a fan arranged outside. Therefore, the cooling structure becomes complicated and the equipment cost is raised.

SUMMARY OF THE INVENTION

It is an object of the present invention to make gas flow from the heating chamber into the condensing chamber smoothly by solving the above problems.

It is an object of the present invention to solve the above problems and enhance the cooling efficiency of cooling steam by an arrangement at low equipment cost.

In order to solve the above problems, the present invention described in Aspect 1 provides a garbage disposer comprising: a heating section for heating garbage; a condensing section for cooling gas containing steam generated from the garbage, communicated with the heating section; a drainage path for discharging water condensed in the condensing section to the outside; and a returning means for forcibly returning gas, which has been cooled in the condensing section, to the heating section.

In order to solve the above problems, the present invention described in Aspect 2 provides a garbage disposer according to Aspect 1, wherein the returning means includes a communicating passage for communicating the downstream side of the condensing section with the heating section, and a fan arranged in the communicating passage, by which gas is made to flow from the condensing section side to the heating section side.

In the garbage disposer described in Aspect 1 of the present invention, garbage is heated in the heating section and water contained in garbage is evaporated, and gas is cooled in the condensing section communicated with the heating section so as to condense steam. Further, by the arrangement in which gas cooled in the condensing section is forcibly returned to the heating section by the returning means, gas in the heating section, which contains a large quantity of steam, is made to smoothly flow into the condensing section, and at the same time gas cooled in the condensing section, which contains a small quantity of steam, is returned to the heating section. Due to the foregoing, it is possible to evaporate water contained in garbage effectively, and the thus evaporated steam can be condensed effectively. Further, most of the offensive smell generated from garbage can be discharged outside, for example, most of the offensive smell generated from garbage can be discharged into the drainpipe together with condensed water.

In the garbage disposer having the above arrangement described in Aspect 2, there is provided a communicating passage for communicating the downstream side of the condensing section with the heating section. When gas is made to flow from the condensing section to the heating section by the fan arranged in the communicating passage, it is possible to forcibly return gas, which has been cooled in the condensing section, to the heating section, so that gas can be made to smoothly flow from the heating section to the condensing section.

In order to solve the above problems, the present invention described in Aspect 3 provides a garbage disposer comprising: a heating section for heating garbage; a condensing section for cooling gas containing steam generated from the garbage, communicated with the heating section; and a drainage path for discharging water condensed in the condensing section to the outside, wherein the condensing section is composed of two plates, which are put on each other, at least one of which has recess portions, and peripheries of the two plates are sealed so that a space is formed between them, and a plurality of partition walls are provided in the space so that gas can be guided zigzag by the partition walls.

In order to solve the above problems, the present invention described in Aspect 4 provides a garbage disposer according to Aspect 3, in which the condensing section is arranged so that the two plates can be perpendicularly set and gas can be guided zigzag in the upward and the downward direction between the two plates, and the plurality of partition walls are composed in such a manner that a lower end opening partition wall, only the lower end of which is open, and an upper and lower end opening partition wall, both end portions of which are open, the lower end portion of which is lower than the lower end opening partition wall, are alternately arranged.

In order to solve the above problems, the present invention described in Aspect 5 provides a garbage disposer according to Aspect 4, further comprising a shut-off drainage section, wherein a condensation pool is formed in a path from the condensing section to the water drainage path, the path from the condensing section to the water drainage path is shut off by water in the condensation pool when water in the condensation pool exceeds a predetermined shut-up water level, and water exceeding a predetermined drainage level, which is higher than the shut-up water level, is discharged to the water drainage path, and air on the water drainage path side is sucked onto the condenser side when the pressure in the condensing section is decreased to be lower than the pressure in the drainage path and the level of water in the condensation pool on the drainage path side is decreased to a predetermined tightly closing level. In order to solve the above problems, the present invention described in Aspect 6 provides a garbage disposer according to Aspect 3, 4, or 5, further comprising: a returning means for forcibly returning gas cooled in the condensing section to the heating section; and a blowing nozzle for blowing gas, which has been returned to the heating section, toward garbage.

In the garbage disposer described in Aspect 3 of the present invention, garbage is heated and water contained in garbage is evaporated. Gas is cooled in the condensing section communicated with the heating section, so that steam can be condensed. This condensing section is composed as follows. Two plates, at least one of which has recess portions, are put on each other, and peripheries of the two plates are sealed so that a space can be formed between the two plates. A plurality of partition walls are formed in the space. Therefore, gas is guided zigzag between the partition walls arranged between the two plates. Due to the above arrangement, gas sent from the heating section is guided zigzag in the condensing section. Accordingly, the inside of the plate and steam easily come into contact with each other, and the cooling efficiency can be enhanced. Most of the offensive smell generated from garbage can be discharged outside together with condensed water, for example, most of the offensive smell generated from garbage can be discharged into a drainpipe.

Further, in the garbage disposer described in Aspect 4 of the present invention, the plates are arranged perpendicularly. Therefore, gas is guided zigzag in the perpendicular direction. Due to the foregoing, outside air smoothly flows on the outside of the plate by a draft force. Accordingly, the cooling efficiency can be enhanced. When steam is condensed to water in the zigzag passage, water flows on the perpendicular surface and drops down. In this case, only when the zigzag passage is provided, water stays in a lower portion of the passage, and the path of gas is closed. However, when the lower end opening partition wall, only the lower end of which is open, and the upper and lower end opening partition wall, both end portions of which are open, and the lower end portion of which is lower than the lower end opening partition wall, are alternately arranged, a communicating passage is formed in the lower portion. Therefore, water dropping from the zigzag passage can be stored in one portion and guided into the drainage path, and further gas can be prevented from leaking out and flow zigzag because the level of water staying in the lower portion is higher than the lower end of the upper and lower end opening partition wall, both end portions of which are open.

In the garbage disposer described in Aspect 5 of the present invention, a condensation pool is formed in a path from the condensing section to the water drainage path, and the path from the condensing section to the water drainage path is shut off by water in the condensation pool when water in the condensation pool exceeds a predetermined shut-up water level. Due to the foregoing, the communicating space including the heating chamber and the condensation chamber is tightly closed. In this tightly closed space, garbage is heated and generated steam is condensed. Therefore, it is possible to prevent steam from being discharged outside before it is condensed. Water condensed in the condensing section is sent to the condensation pool. Concerning water staying in the condensation pool, when water exceeds a predetermined water drainage level, it is discharged outside from the drainage path, for example, it is discharged into a drainpipe. Accordingly, there is no possibility that the level of water staying in the condensation pool continues to rise. When the pressure in the tightly closed space becomes negative with respect to the pressure in the drainage path, the level of water in the condensed water pool on the drainage path side is decreased, and at the same time, the level of water in the condensed water pool on the condensing section side is increased. When the level of water on the drainage path side is decreased to a predetermined shut-up level, air is sucked from the drainage path side into the tightly closed space. Therefore, it is possible to prevent the level of water on the condensing section side from increasing extremely.

In the garbage disposer described in Aspect 6 of the present invention, gas cooled in the condensing section is forcibly returned to the heating section. Therefore, gas in the heating section containing a large quantity of steam smoothly flows into the condensing section, and also gas cooled in the condensing section, which contains a small quantity of steam, smoothly flows into the heating section. Accordingly, water contained in garbage can be effectively evaporated and the thus evaporated steam is effectively condensed. When gas returned to the heating section is blown against garbage, the evaporation of water contained in garbage is facilitated.

In order to solve the above problems, the present invention described in Aspect 7 provides a garbage disposer comprising: a heating section for heating garbage; a condensing section for cooling and condensing steam generated from the garbage, communicated with the heating section; an automatically adjusting drainage means for draining water condensed in the condensing section and also for automatically adjusting pressure in the heating chamber; and a returning means for forcibly returning gas cooled in the condensing section to the heating section, wherein the automatically adjusting drainage means is connected to the high pressure side of the returning means.

In this case, as the present invention described in Aspect 8, it is preferable that the maximum pressure on the high pressure side of the returning means is not higher than a difference in pressure generated by the returning means.

According to the garbage disposer of the present invention described in Aspect 7, the automatically adjusting drainage means is communicated with the high pressure side of the returning means. Therefore, the maximum pressure on the high pressure side of the returning means is limited to a value not higher than a predetermined value. Accordingly, the heating chamber can be kept in a depressurized condition or a slightly positive pressure condition, and the leakage of offensive smell components can be reduced.

According to the present invention described in Aspect 8, when the returning means and/or the automatically adjusting drainage means is composed so that the maximum pressure on the high pressure side of the returning means can not be higher than a pressure difference generated by the returning means, the heating chamber, which is on the low pressure side, can be kept at the substantially same pressure as the atmospheric pressure, or the heating chamber can be kept in a depressurized condition. Due to the foregoing, it becomes unnecessary to balance a quantity of heat charged into the heating chamber with a quantity of heat absorbed by the condensing section. Therefore, operation of the garbage disposer can be simplified.

DETAILED DESCRIPTION OF THE PREFERRED EMBODIMENTS

In order to make the structure and operation of the present invention clearer, a preferred example of the garbage disposer of the present invention will be explained as follows.

First Embodiment

Figure 1:
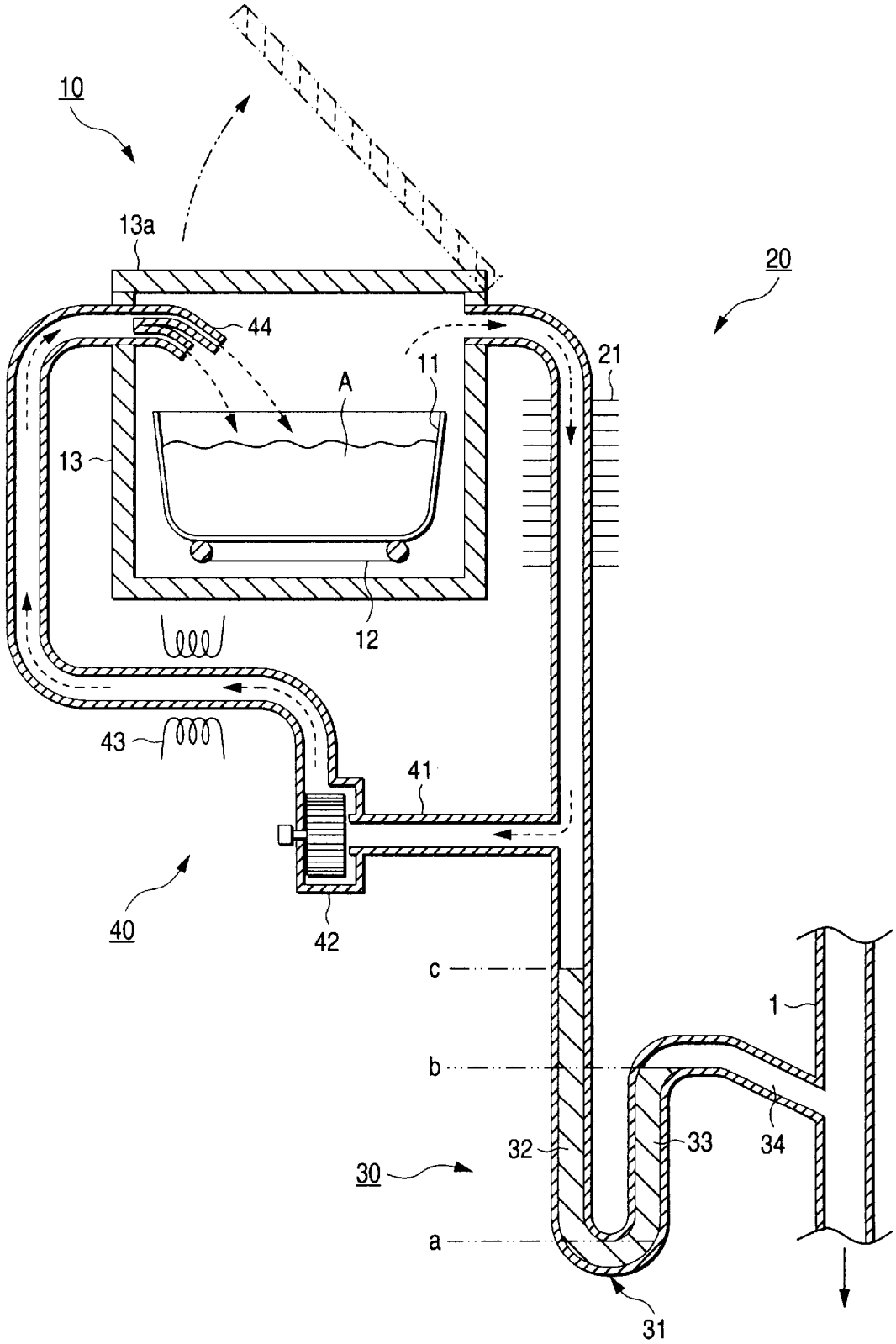
FIG. 1 is a schematic illustration showing an outline of an example of the first embodiment of the garbage disposer.

FIG. 1 is a schematic arrangement view of the first embodiment of the garbage disposer of the present invention. This garbage disposer includes: a heating section 10 for heating garbage A; a condensing section 20 for condensing steam generated from garbage A; a shut-off drainage section 30 for communicating the condensing section 20 with the drainpipe 1 so as to drain water and also for shutting off the communication of gas according to the state of staying water; and a returning section 40 for returning gas, which has been cooled in the condensing section 20, to the heating section 10.

The heating section 10 includes: a processing tank 11 for accommodating garbage; a heater 12 for heating the processing tank 11; and a heating chamber 13 having a heat insulating structure for accommodating the processing tank 11 and the heater 12. In an upper portion of the heating chamber 13, there is provided a cover 13*a* to be opened and closed when the processing tank 11 is put into and taken out from the heating chamber 13.

The condensing section 20 includes a fin tube 21 communicating with an upper portion of the heating chamber 13.

The shut-off drainage section 30 is composed of an S-shaped tube 31 including: a downward path 32 in which water sent from the fin tube 21 flows downward; an upward path 33 which rises upward from the downward path 32; and a drainage path 34 which is arranged downward from the upward path 33 and communicates with the drain pipe 1.

The returning section 40 includes a returning pipe 41 which communicates the downstream side of the fin tube 21 with the heating chamber 13. In this returning pipe 41, there are provided a fan 42 by which gas is made to flow in the direction from the fin tube 21 to the heating chamber 13, a heater 43 for heating gas which is arranged in the downstream of the fan 42, and a nozzle 44 for jetting gas from a side edge portion on the downstream side toward garbage A accommodated in the heating chamber 13.

Next, operation of this garbage disposer will be explained as follows. When garbage A is charged into the processing tank 11, drying operation is started. Then, the heater 12 starts heating the processing tank 11. Therefore, temperatures in the processing tank 11 and the heating chamber 13 are raised, and water contained in garbage A is evaporated. Under the condition that water in S-shaped tube 31 has not reached level "a", air in the heating chamber 13 and the fin tube 21 is pushed out into the drainpipe 1 by the action of steam generated from garbage. On the other hand, when a predetermined period of time has passed from the start of heating the processing tank 11 conducted by the heater 12 for heating the processing tank, the fan 42 in the returning section 40 and the heater 43 for heating gas are started. Due to the above operation, gas in the heating chamber 13 containing a large quantity of steam flows into the condensing section 20 and is cooled when it flows in the fin tube 21. The thus cooled gas flows in the returning pipe 41 and returns into the heating chamber 13. In this case, gas sent from the heating chamber 13 into the fin tube 21 is cooled so that the temperature of gas is decreased to the dew point. Accordingly, steam contained in gas is condensed to water and drops into the S-shaped tube 31. Gas containing a small quantity of steam is heated by the heater 43 used for heating gas when it flows in the returning pipe 41, so that gas is heated to a high temperature. After that, gas is jetted out from the nozzle 44 to garbage A accommodated in the processing tank 11. When gas heated to a high temperature by the heater 43 for heating gas is directly jetted out to garbage A as described above, the evaporation of water contained in garbage A is facilitated, and dew condensation in the return pipe 41 can be prevented. On the other hand, water which has condensed and dropped into the S-shaped tube 31 stays in a U-shaped portion at which the downward passage 32 is connected with the upward passage 33. When the level of water staying in the U-shaped portion is raised to the level "a", the passage through which the downward passage 32 is communicated with the upward passage 33 is shut off. Accordingly, a space containing the heating chamber 13 and the fin tube 21 is tightly closed from the outside. In this case, a portion of air existing in the tightly closed space at the start of operation is pushed out to the drainpipe 1 side. Therefore, when a quantity of condensed water is increased by reducing a quantity of heat given to gas by the heating chamber 13 to be smaller than a quantity of heat taken away from gas by the fin tube 21, it is possible to decrease pressure in the tightly closed space. Accordingly, pressure in the heating chamber 13 becomes negative, and the boiling point is lowered, and it becomes possible to evaporate water at low temperature. Also, it becomes possible to prevent offensive smell components from leaking out from a gap between the cover 13*a* and the heating chamber 13.

When water drops from the fin tube 21, a quantity of water staying in the S-shaped tube 31 increases, however, when the level of staying water in the upward path 33 exceeds the water level "b", water flows into the drainpipe 1 via the drainage path 34. Accordingly, there is no possibility that staying water continues to increase. Therefore, the water level can be stabilized. A difference between the water level in the downward path 32 and the water level in the upward path 33 is determined by a difference between the pressure in the closed space and the pressure in the drainpipe 1. Therefore, when the pressure in the closed space is kept negative, the water level in the downward path 32 is stabilized at the water level "c" which is higher than the water level "b" of the upward path 33. Most of the offensive smell components generated from garbage A are dissolved in water staying in the S-shaped tube 31 and discharged into the drainpipe 1.

By the action of the S-shaped tube 31, pressure in the closed space is spontaneously adjusted. For example, when pressure in the closed space increases exceeding the atmospheric pressure, the water level in the downward path 32 is lowered. When the water level in the downward path 32 is lowered to the water level "a", gas in the downward path 32 is discharged into the upward path 33. For the above reasons, pressure in the closed space is increased only to a predetermined value determined by a difference between the water level in the upward path 33 and the water level in the downward path 32.

On the other hand, when pressure in the closed space is decreased to a value lower than the atmospheric pressure, the water level in the downward path 32 is increased, and the water level in the upward path 33 is decreased. When the water level in the upward path 33 is decreased to the water level "a", gas in the upward path 33 is sucked into the downward path 32. For the above reasons, pressure in the closed space is decreased only to a predetermined value determined by a difference between the water level in the downward path 32 and the water level in the upward path 33.

As explained above, in the garbage disposer of this example, there is provided a returning tube 41 for returning gas, which has been cooled in the fin tube 21, to the heating chamber 13, and gas in the tightly closed space is forcibly circulated by the fan 42. Due to the foregoing, gas containing a large quantity of steam can be made to flow into the fin tube 21, and also gas cooled by the fin tube 21, which contains a small quantity of steam because of the cooling by the fin tube 21, can be returned to the heating chamber 13. Accordingly, water contained in garbage A can be effectively evaporated and also generated steam can be effectively condensed, that is, the drying performance can be enhanced. When gas sent to the heating chamber 13 through the returning pipe 41 is heated, gas of high temperature is directly jetted out to garbage A, so that the evaporation of water in garbage A can be facilitated, and at the same time dew condensation of steam in the returning pipe 41 can be prevented. When the path by which the downward path 32 is communicated with the upward path 33 is shut off by water staying in the S-shaped tube 31, it is possible to tightly close the communicating space composed of the heating chamber 13 and the fin tube 21 without using an opening and closing valve such as an electromagnetic valve. Therefore, the equipment cost can be reduced. When water in the upward path 33 exceeds the water level "b", it flows into the drainpipe 1 via the drainage path 34. Consequently, it is possible to discharge water while the tightly closed condition is kept. Further, it is possible to adjust a pressure range in the closed space by the difference between the water level in the upward path 33 and the water level in the downward path 32. Accordingly, it is possible to prevent the deterioration of the heating efficiency and to prevent the leakage of the offensive smell caused when pressure in the closed space is raised to a high value. Also, it is possible to prevent a back current of water from the S-shaped tube 31 to the heating chamber 13 which is caused when pressure in the closed space is raised to a low value.

According to the arrangement of this example, steam generated from heated garbage A is condensed and discharged together with the offensive smell components.

Therefore, it is possible to prevent the offensive smell from leaking out and to prevent the humidity from rising. Accordingly, the deterioration of the environment in the kitchen can be prevented. Since the heating chamber 13 is kept at a negative pressure, it is possible to prevent the offensive smell from leaking out from a clearance between the cover 13*a* and the heating chamber 13. Therefore, it is unnecessary to provide an excessively high sealing property. Since the boiling point is lowered, drying of garbage can be conducted at low temperature. Therefore, it is possible to reduce energy required for heating and also it is possible to reduce electric power consumption. As a result, it is possible to prevent the temperature in the kitchen from rising. In addition to the above advantages, since the heating chamber 13 is kept at a negative pressure, it is unnecessary to provide expensive devices such as a vacuum pump. Further, it is unnecessary to provide a deodorizing device and a steam exhausting device. Therefore, the structure can be made simple and the equipment cost can be reduced.

In this connection, in this example, the fan 42 and the heater 43 for heating gas are set in motion after a predetermined period of time has passed from the start of heating conducted by the heater 12 used for heating the processing tank. However, it should be noted that the present invention is not limited to the above specific example. For example, the temperature, humidity or pressure in the fin tube 21 or the heating chamber 13 is detected, or alternatively the level of water in the shut-off drainage section 30 is detected, and the fan 42 and the heater 43 for heating gas may be set in motion according to the detected value. Alternatively, the fan 42 and the heater 43 for heating gas may be set in motion simultaneously with the start of operation of the heater 12 for heating the processing tank.

A quantity of water necessary for shutting off the communicating passage of gas after the start of the drying process is decreased by reducing the lower space of the S-shaped tube 31. In this way, a period of time required for shutting off may be decreased. Alternatively, the communicating passage of gas may be shut off under the condition that water is stored in the S-shaped tube 31 at all times.

Cooling of the condensing section 20 is not limited to natural cooling, for example, it is possible to adopt a cooling means for cooling the condensing section 20 by a fan arranged outside so that cooling air can be sent to the condensing section 20.

Garbage A is not necessarily heated by the heater 12 for heating the processing tank 12, but it may be heated by means of gas burners or microwaves.

In this example, gas flowing in the returning pipe 41 is heated by the heater 43 for heating gas, but gas flowing in the returning pipe 41 may not be heated. It is possible to adopt an arrangement in which the heater 12 for heating the processing tank is not used and water contained in garbage A is evaporated by a blast of hot air heated by the heater 43 for heating gas.

In this example, the space including the heating chamber 13 and the fin tube 21 is tightly closed and kept at a negative pressure, however, it is possible to adopt an arrangement in which the space is not kept at a negative pressure, and also it is possible to adopt an arrangement in which the space is not tightly closed.

Figure 2:
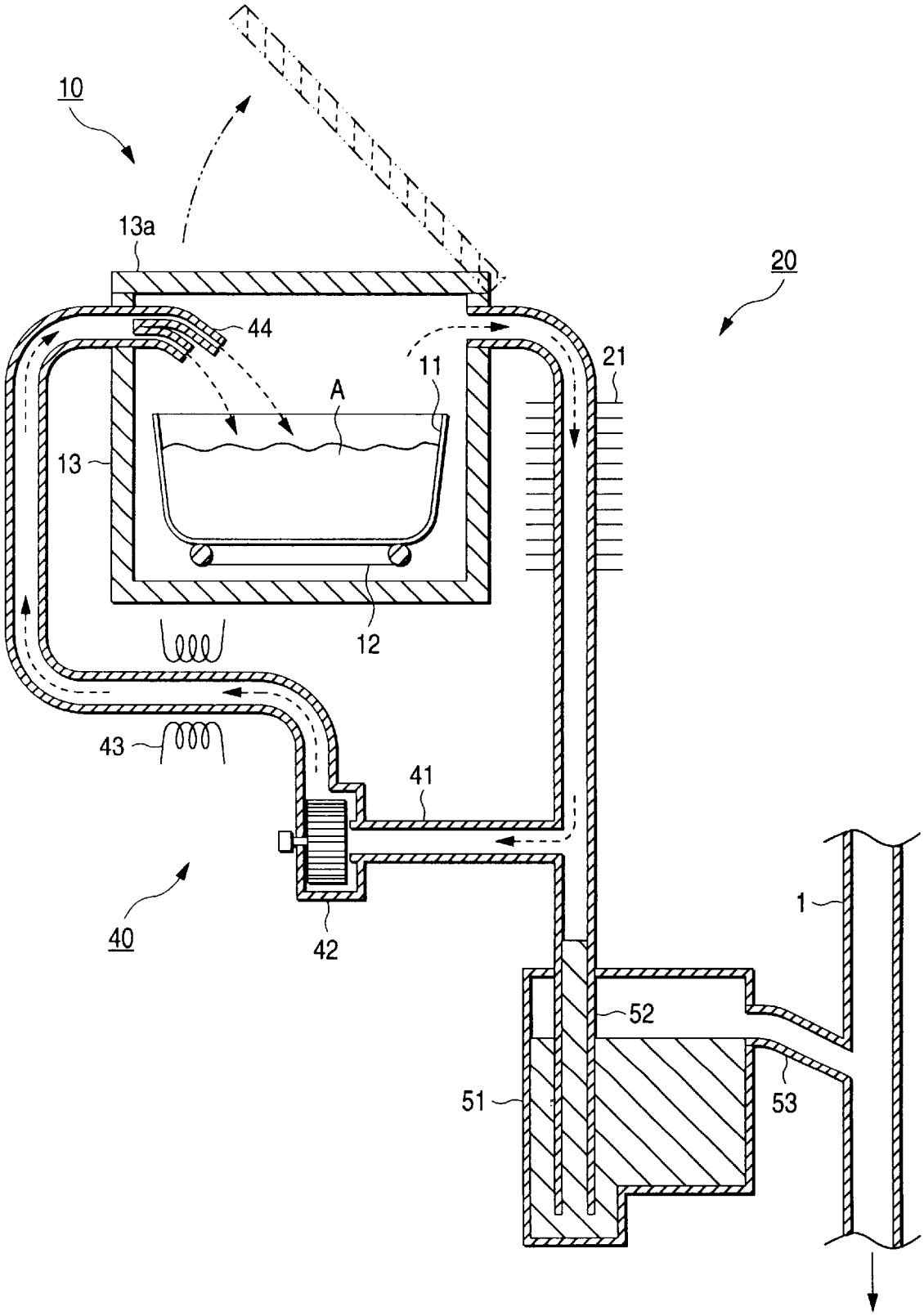
FIG. 2 is a schematic illustration showing an outline of another example of the shut-off drainage section.

The shut-off drainage section 30 is not limited to the S-shaped tube. For example, as shown in FIG. 2, the shut-off drainage section 30 may include: a tank 51 for storing water; a condensed water discharge pipe 52, which is arranged downward facing a bottom surface of the tank 51, in which water sent from the fin tube 21 flows downward; and a water discharge pipe 53 which communicates an upper side of the tank 51 with the drainpipe 1 and discharges water into the drainpipe 1 when water in the tank 51 exceeds a predetermined water level. According to the above arrangement, when the space is kept at a negative pressure, the shut-off condition can be kept until the level of water staying in the tank 51 is lowered to a lower end surface of the condensed water discharge pipe 52. Accordingly, when the height of the condensed water discharge pipe 52 is increased in the perpendicular direction and the capacity of the tank 51 is extended, it is possible to set a high limit value of the negative pressure irrespective of a limit value of the positive pressure. The passage may not be shut off by water, for example, the passage may be shut off by an opening and closing valve such as an electromagnetic valve.

Figure 3:
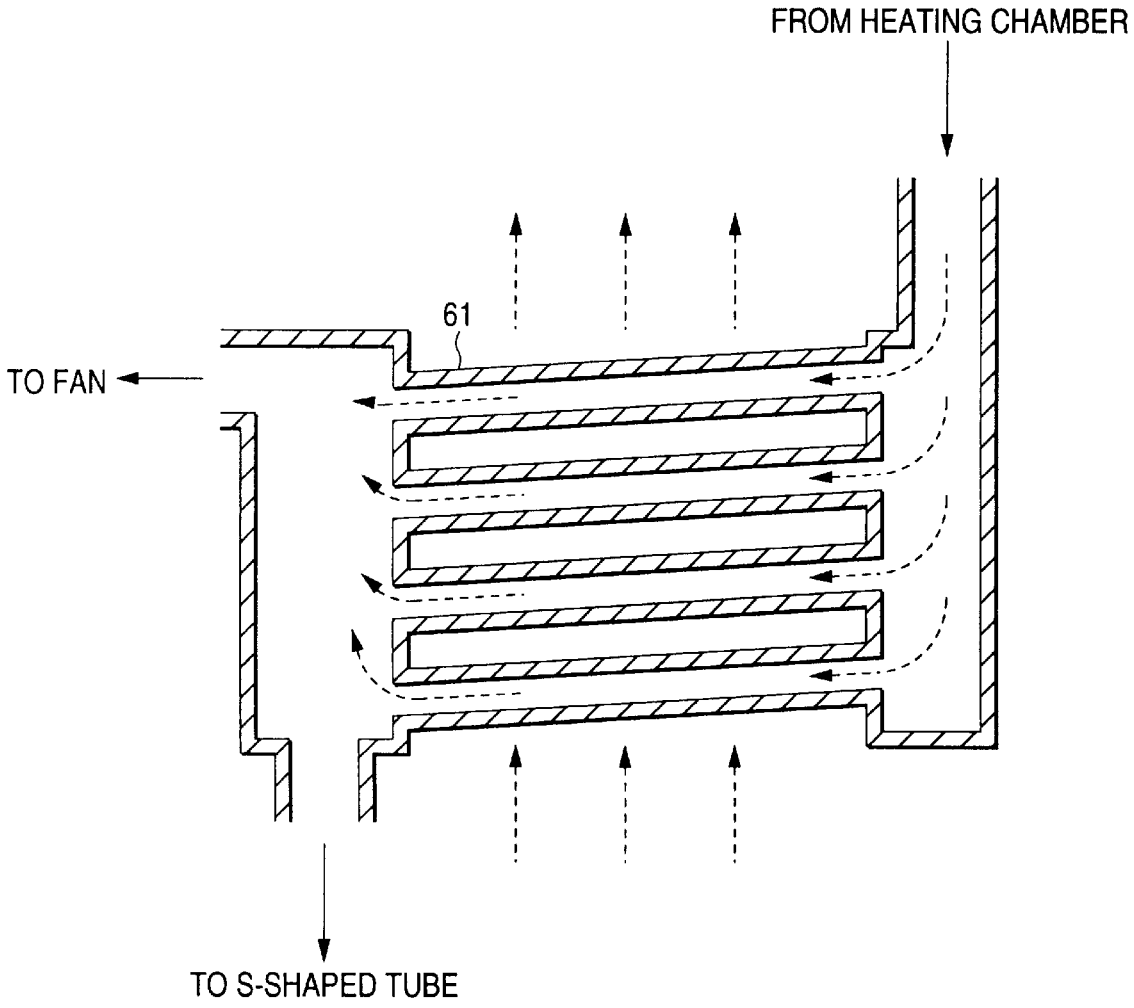
FIG. 3 is a schematic illustration showing an outline of another example of the condensing section.

The condensing section 20 is not limited to a structure in which the fin tube is arranged. For example, as shown in FIG. 3, it is possible to adopt a structure in which a plurality of pipes 61, . . . are obliquely arranged at an arbitrary angle. In the above structure, the pipes 61, . . . are cooled by air flowing upward round the pipes 61, . . . Since the pipes are obliquely arranged, water condensed in the pipes 61, . . . can be made to flow onto the S-shaped tube 31 side easily.

Second Embodiment

Figure 4:
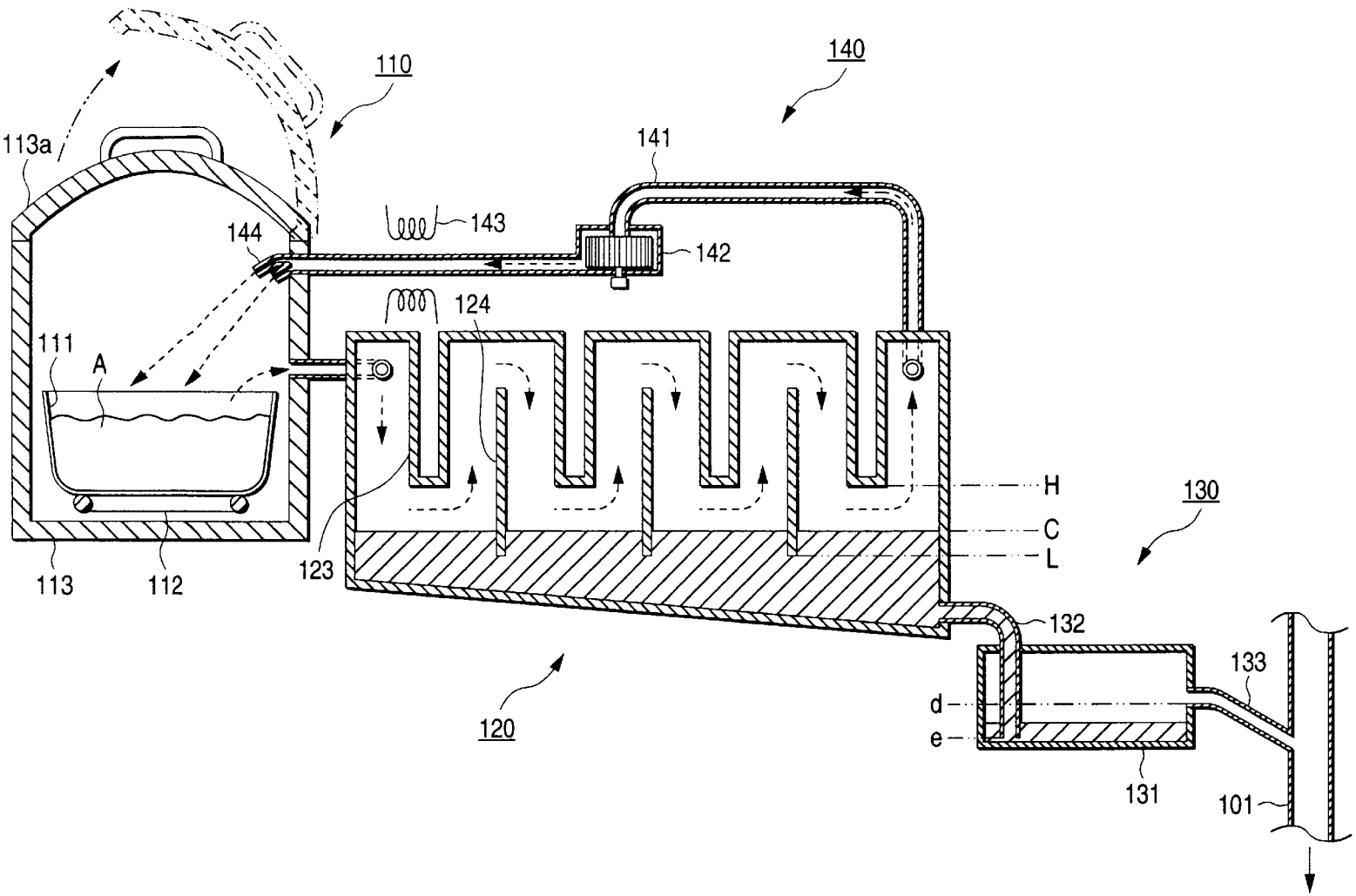
FIG. 4 is an arrangement view showing an outline of an example of the second embodiment of the garbage disposer.

FIG. 4 is a schematic arrangement view of the second embodiment of the garbage disposer of the present invention. This garbage disposer includes: a heating section 110 for heating garbage A; a condensing section 120 for -condensing steam generated from garbage A; a shut-off drainage section 130 for communicating the condensing section 120 with the drainpipe 101 so as to drain water and also for shutting off the communication of gas according to the state of staying water; and a returning section 140 for returning gas, which has been cooled in the condensing section 120, to the heating section 110.

The heating section 110 includes: a processing tank 111 for accommodating garbage A; a heater 112 for heating the processing tank 111; and a heating chamber 113 having a heat insulating structure for accommodating the processing tank 111 and the heater 112. In an upper portion of the heating chamber 113, there is provided a cover 113*a* to be opened and closed when the processing tank 111 is put into and taken out from the heating chamber 113.

Figure 5:
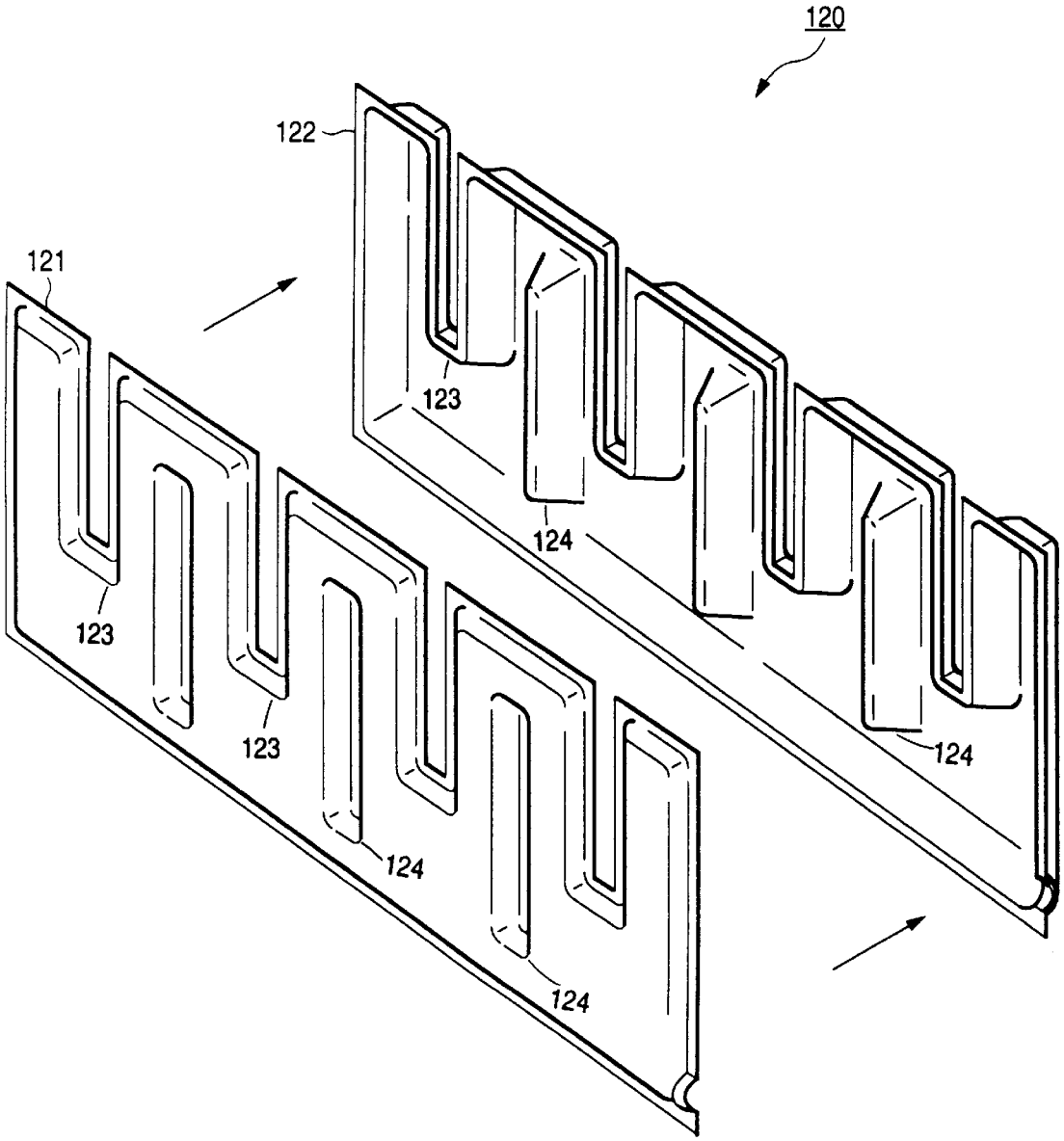
FIG. 5 is a schematic illustration of the condensing section.

As shown in FIG. 5, the condensing section 120 is composed as follows. There are provided two metallic plates 121, 122 having recesses formed into a predetermined shape. These two metallic plates 121, 122 are put on each other, and the peripheries of the metallic plates 121, 122 are sealed by means of seam welding so that a space can be formed between the two metallic plates. Lower end opening partition walls 123, 123, . . . , only the lower ends of which are open, and upper and lower end opening partition walls 124, 124, . . . , both end portions of which are open, are alternately arranged in the space. In this case, the lower end portions of the upper and lower end opening partition walls 124, 124, . . . , both end portions of which are open, are lower than the lower end portions of the lower end opening partition walls 123, 123, . . . When water, the level of which is "L", stays in the inner space, only the lower end openings of the upper and lower end opening partition walls 124, 124, . . . , both end portions of which are open, are closed by water. Therefore, a passage can be formed, by which gas is guided zigzag in the upward and downward direction. The bottom surface of the lower communicating space is inclined downward to the shut-off drainage section 130, so that water can flow on the bottom surface easily.

When the two metallic plates 121, 122 are perpendicularly arranged, outside air can smoothly flow upward on the external surfaces of the plates by the action of a draft force. Accordingly, it is possible to enhance the cooling efficiency. Since the partition walls are formed, which are arranged zigzag in the upward and downward direction, water generated by dew condensation easily drops down on the perpendicular surface. In the case where the communicating space is not formed in the lower portion and only the passages, which are arranged zigzag in the upward and downward direction, are formed, a quantity of water condensed in the passage is increased, and the path of gas is closed by water staying in the passage. However, when the communicating space is formed in the lower portion, water generated by dew condensation in the passage can be sent to the shut-off drainage section 130, and further when the staying water closes the communicating space, gas can be made to flow zigzag.

The shut-off drainage section 130 includes: a tank 131 for storing water; a condensed water discharge pipe 132 in which water sent from the condensing section 120 flows downward, the condensed water discharge pipe 132 facing the bottom surface of the tank 131; and a drainage pipe 133 for discharging water, which has exceeded a predetermined water level "d" in the tank 131, into the drainpipe 101, wherein the drainage pipe 133 communicates an upper portion of the side of the tank 131 with the drainpipe 101. Due to the above arrangement, under the condition that the level of water in the tank 131 is higher than the level "e", which is a level of the lower end opening surface of the condensed water discharge pipe 132, it is possible to shut off the space, in which the heating chamber 113 and the condensing section 120 are communicated with each other, from the outside.

The returning section 140 includes a returning pipe 141 for communicating the downstream side of the condensing section 120 with the heating chamber 113. In this returning pipe 141, there are provided a fan 142 by which gas is made to flow in the direction from the condensing section 120 to the heating chamber 113, a heater 143 for heating gas which is arranged in the downstream of the fan 142, and a nozzle 144 for jetting gas from a side edge portion on the downstream side toward garbage A accommodated in the heating chamber 113.

Figure 6:
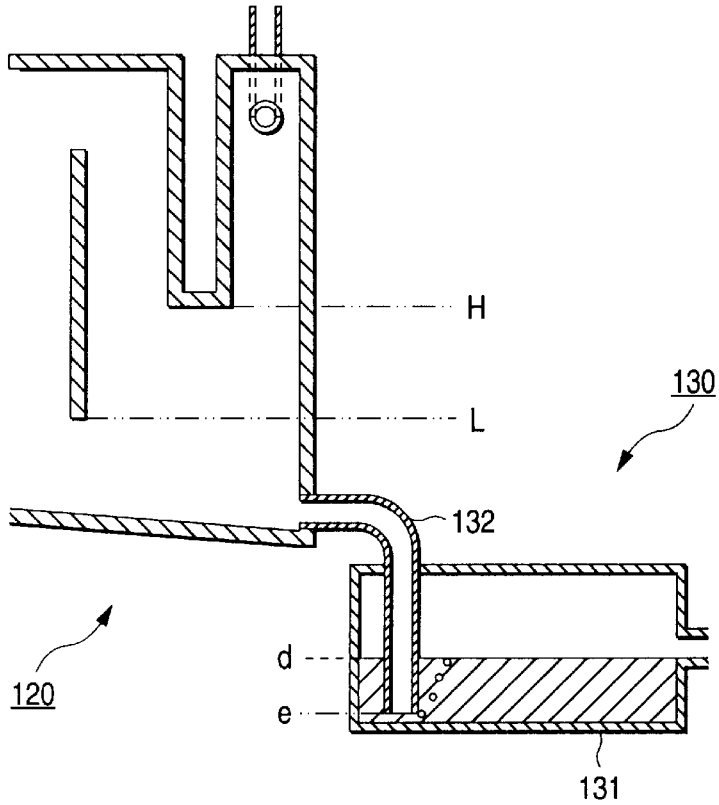
FIG. 6 is a schematic illustration for explaining levels of water in the condensing section and the shut-off drainage section.
Figure 7:
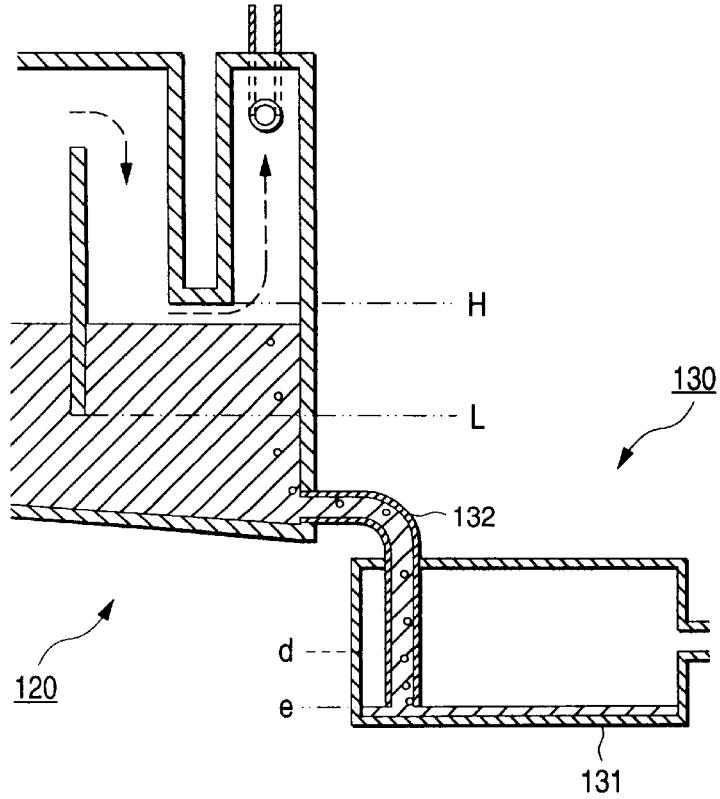
FIG. 7 is a schematic illustration for explaining levels of water in the condensing section and the shut-off drainage section.

Next, operation of this garbage disposer will be explained as follows. When garbage A is charged into the processing tank 111 and drying operation is started, the heater 112 starts heating the processing tank 111. Therefore, temperatures in the processing tank 111 and the heating chamber 113 are raised, and water contained in garbage A is evaporated. Accordingly, pressure in the space in which the heating chamber 113 and the condensing section 120 are communicated with each other is increased. When the level of water in the condensed water discharge pipe 132 is decreased to the level "e" of water which is the same as the level of the lower end opening surface, air existing in the heating chamber 113 and the condensing chamber 120 is pushed out to the drainpipe 101 as shown in FIG. 6. Therefore, pressure is increased only to a value determined by a difference of the level of water between the tank 131 and the condensed water discharge pipe 132. On the other hand, when a predetermined period of time has passed from the start of heating the processing tank conducted by the heater 112 for heating the processing tank, the fan 142 in the returning section 140 and the heater 143 for heating gas are set in motion. Due to the above operation, gas in the heating chamber 113 containing a large quantity of steam flows into the condensing section 120 and is cooled when it flows zigzag. The thus cooled gas flows in the returning pipe 141 and returns into the heating chamber 113. In this case, gas sent from the heating chamber 113 into the condensing section 120 is cooled so that the temperature of gas is decreased to the dew point. Accordingly, steam contained in gas is condensed to water and stays in a lower portion of the condensing section 120 and drops down into the condensed water discharge pipe 132. When a quantity of condensed water is increased by reducing a quantity of heat given to gas in the heating chamber 113 to be smaller than a quantity of heat taken away from gas in the condensing section 120, it is possible to decrease pressure in the heating chamber 113 and the condensing section 120. Accordingly, a quantity of water staying in the tank 131 increases. Therefore, the space by which the heating chamber 113 and the condensing section 120 are communicated with each other is shut up from the outside. Since a portion of air existing at the start of operation has been pushed out into the drainpipe 101, pressure in the tightly closed space can be made negative.

Gas containing a small quantity of steam is heated by the heater 143 used for heating gas when it flows in the returning pipe 141, so that gas is heated to a high temperature. After that, gas is jetted out from the nozzle 144 to garbage A accommodated in the processing tank 111. When gas heated by the heater 143 for heating gas, the relative humidity of which has become low, is directly jetted out to garbage A as described above, the evaporation of water contained in garbage A is facilitated, and dew condensation in the return pipe 141 can be prevented. Further, pressure in the heating chamber 113 becomes negative, and the boiling point is lowered, and it becomes possible to evaporate water at low temperature. Also, it becomes possible to prevent offensive smell components from leaking out from a gap between the cover 113*a* and the heating chamber 113.

When water drops from the condensing section 120, a quantity of water staying in the tank 131 increases, however, when a water level of staying water in the tank 131 exceeds the water level "d", water flows into the drainpipe 101 via the drainage path 133. Accordingly, there is no possibility that staying water continues to increase. Therefore, the water level can be stabilized. Most of the offensive smell components generated from garbage A are dissolved in water staying in the tank 131 and discharged into the drainpipe 101. A difference in the level of water between the condensed water discharge pipe 132 and the tank 131 is determined by a difference in the pressure between the tightly closed space and the drain pipe 101. Therefore, when pressure in the tightly closed space is negative, the level of water in the condensed water discharge pipe 132 or the condensing section 120 is stabilized at level "C" of water which is higher than the level of water in the tank 131. When this level "C" of water becomes higher than the level "L" of water which is the same as the level of a lower end of the two end opening partition wall 124, the passage in which gas is guided zigzag can be formed as shown in FIG. 4.

On the other hand, when pressure in the tightly closed space continues to decrease, the difference of the level of water between the condensing section 120 and the tank 131 is increased. When the level of water in the condensing section 120 becomes higher than level "H" of water which is the same as the level of the lower end portion of the lower end opening partition wall 123, the passage of gas is shut off. However, when a quantity of water in the tank 131 is decreased and the level of water in the tank 131 is decreased to the level "e", air in the tank 131 is sucked by the condensed water discharge pipe 132. In this way, an extreme reduction of pressure in the tightly closed space can be prevented. Accordingly, it is possible to prevent the level of water in the condensing section 120 from increasing extremely high.

As explained above, according to the garbage disposer of this example, the following advantages can be provided. When the condensing section is composed of the two plates 121, 122 which are put on each other being arranged perpendicularly, outside air can smoothly flow upward on the outside of the plates by a draft force. Further, when gas is guided zigzag, steam contained in gas can be easily contacted with the inside of the plates 121, 122. Therefore, the cooling efficiency can be enhanced. Since the structure of the condensing section 120 is simple, in which the two metallic plates 121, 122 are put on each other, it is possible to reduce the equipment cost. When the path of gas is formed zigzag in the upward and downward direction and the communicating space is formed in the lower portion, it is possible to prevent the passage from being blocked by water condensed in the passage. Further, when the communicating space is closed by water staying in the space, gas is not communicated with each other, but it can flow zigzag. When pressure in the tightly closed space is decreased and the level of water in the tank 131 is decreased to the level "e", air in the tank 131 is sucked into the condensed water discharge pipe 132. Due to the above arrangement, it is possible to prevent the level of water in the condensing section 120 from rising extremely high, that is, it is possible to prevent the path of gas from being blocked by water in the condensing section 120. Further, there is provided a returning pipe 141 for returning gas, which has been cooled in the condensing section 120, to the heating chamber 113, and gas in the tightly closed space is forcibly circulated by the fan 142. Due to the above arrangement, gas containing a large quantity of steam flows smoothly to the condensing section 120, and at the same time, gas, which has been cooled in the condensing section 120, containing a small quantity of steam, flows smoothly into the heating chamber 113. Due to the above arrangement, the evaporation of water contained in garbage A can be conducted at a high efficiency, and the condensation of generated steam can be conducted at a high efficiency, that is, the drying performance can be enhanced. Further, when gas sent to the heating chamber 113 through the returning pipe 141 is heated, gas of a low relative humidity is directly jetted to garbage A, so that the evaporation of water from garbage A can be facilitated, and at the same time, the occurrence of dew condensation in the returning pipe 141 can be prevented. In addition to that, due to the arrangement in which the path of gas communicating the condensing section 120 with the drainpipe 101 is shut off by water staying in the tank 131, the space including the heating chamber 113 and the condensing section 120 can be tightly shut up from the outside without using an opening and closing valve such as an electromagnetic valve. Therefore, the equipment cost can be reduced. Further, when water in the tank 131 exceeds the level "d", it flows into the drainpipe 101 through the water discharge pipe 133. Accordingly, it is possible to discharge water while the tightly closed space is being kept.

According to the arrangement of this example, steam generated from heated garbage A is condensed and discharged together with the offensive smell components. Therefore, it is possible to prevent the offensive smell from leaking out and to prevent the humidity from rising. Accordingly, the deterioration of the environment in the kitchen can be prevented. Since the heating chamber 113 is kept at a negative pressure, it is possible to prevent the offensive smell from leaking out from a clearance between the cover 113*a* and the heating chamber 113. Therefore, it is unnecessary to provide an excessively high sealing property. Since the boiling point is lowered, drying of garbage can be conducted at low temperature. Therefore, it is possible to reduce energy required for heating and also it is possible to reduce electric power consumption. As a result, it is possible to prevent the temperature in the kitchen from rising. In addition to the above advantages, since the heating chamber 113 is kept at a negative pressure, it is unnecessary to provide expensive devices such as a vacuum pump. Further, it is unnecessary to provide a deodorizing device and a steam exhausting device. Therefore, the structure can be made simple and the equipment cost can be reduced.

In this connection, in this example, the fan 142 and the heater 143 for heating gas are set in motion after a predetermined period of time has passed from the start of heating conducted by the heater 112 used for heating the processing tank. However, it should be noted that the present invention is not limited to the above specific example. For example, the temperature, humidity or pressure in the condensing section 120 or the heating chamber 113 is detected, or alternatively the level of water in the shut-off drainage section 130 is detected, and the fan 142 and the heater 143 for heating gas may be set in motion according to the detected value. Alternatively, the fan 142 and the heater 143 for heating gas may be set in motion simultaneously with the start of operation of the heater 112 for heating the processing tank.

Figure 8:
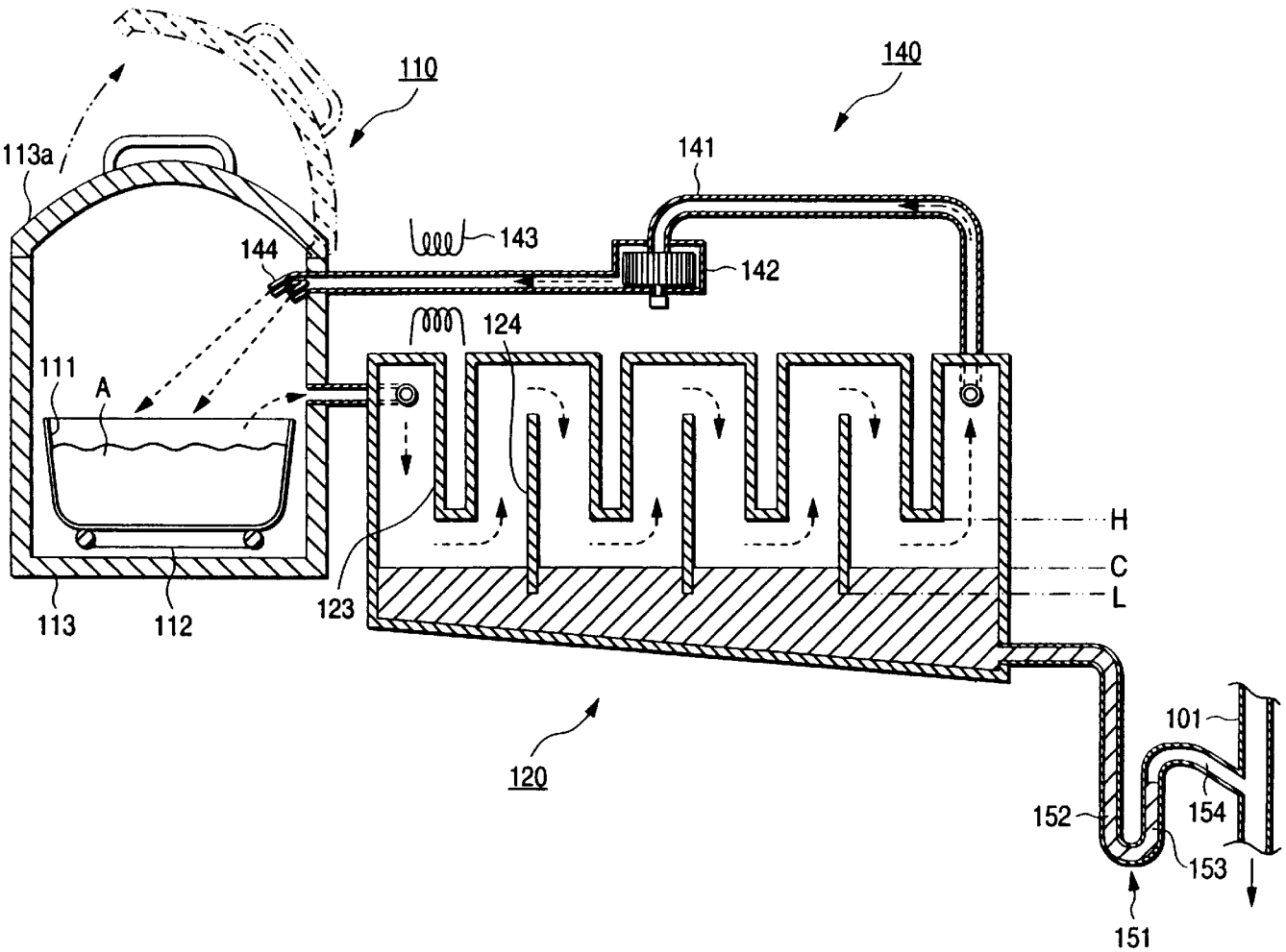
FIG. 8 is an arrangement view showing an outline of another example of the garbage disposer.

The structure of the shut-off drainage section is not limited to the above structure of this example. For example, as shown in FIG. 8, the shut-off drainage section may be composed of an S-shaped tube 151 including: a downward path 152 in which water sent from the condensing section 120 flows downward; an upward path 153 which rises upward from the downward path 152; and a drainage path 154 which is arranged downward from the upward path 153 and communicates with the drainpipe 101. The passage is not necessarily shut off by water, but it may be shut off by an opening and closing valve such as an electromagnetic valve.

Garbage A is not necessarily heated by the heater 112 for heating the processing tank, but it may be heated by means of gas burners or microwaves.

In this example, gas flowing in the returning pipe 141 is heated by the heater 143 for heating gas, but gas flowing in the returning pipe 141 may not be heated. It is possible to adopt an arrangement in which the heater 112 for heating the processing tank is not used and water contained in garbage A is evaporated by a blast of hot air heated by the heater 143 for heating gas. It is possible to adopt an arrangement in which gas is not returned from the condensing section 120 into the heating chamber 113.

Figure 9:
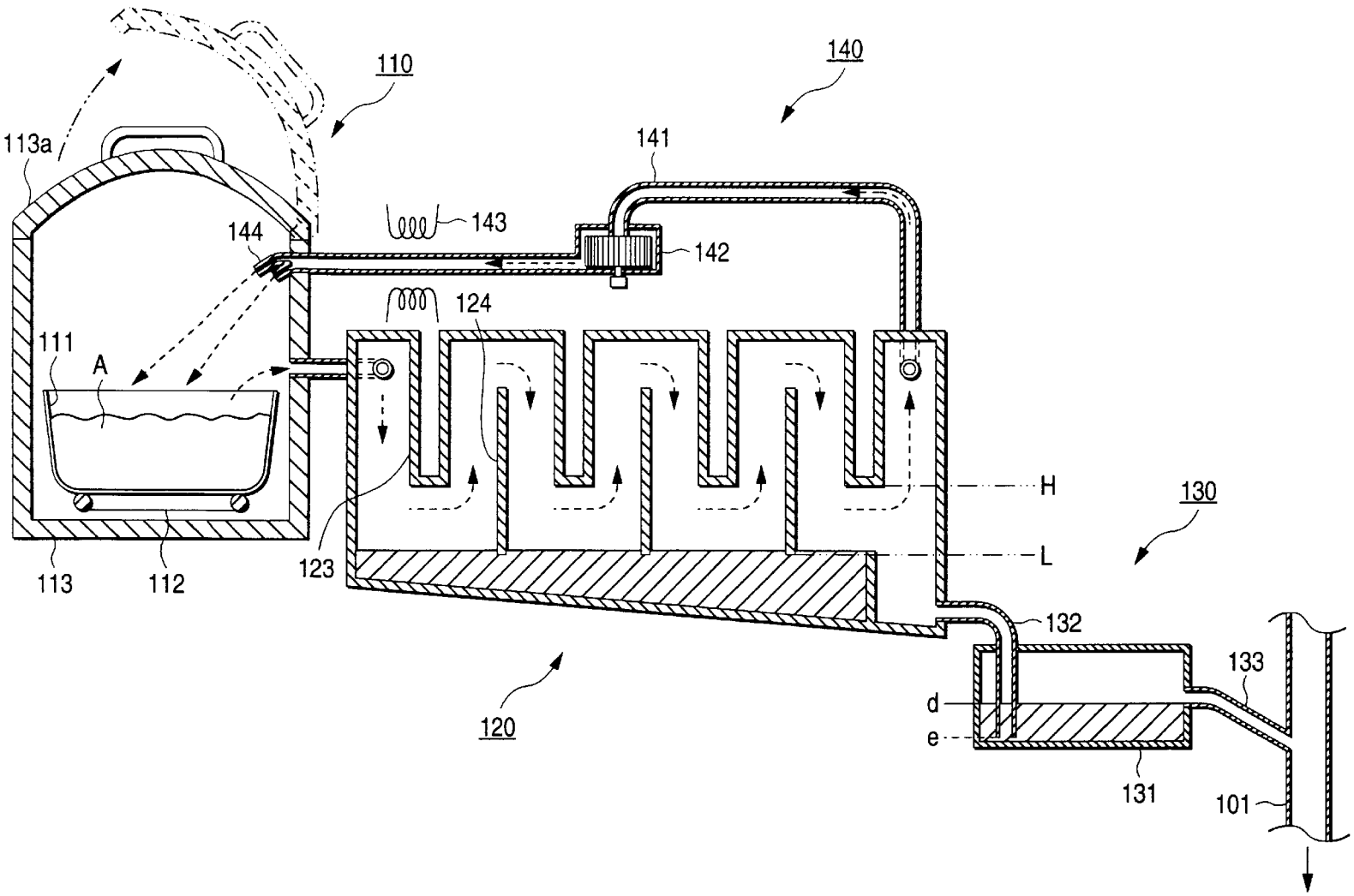
FIG. 9 is an arrangement view showing an outline of still another example of the garbage disposer.

For example, as shown in FIG. 9, water in the condensing section 120 may be made to flow into the tank 131 only when the level of water in the condensing section 120 exceeds a predetermined level higher than level "L" of water which is the same as the level of the lower end of the two end portion opening partition wall 124. According to the above arrangement, it is possible to prevent the path of gas from communicating with each other at the lower portion, irrespective of pressure in the condensing section 120 or irrespective of a quantity of water contained in the tank 131. Therefore, it is possible to make gas flow zigzag at all times.

In this example, the space including the heating chamber 113 and the fin tube 121 is tightly closed and kept at a negative pressure, however, it is possible to adopt an arrangement in which the space is not kept at a negative pressure, and also it is possible to adopt an arrangement in which the space is not tightly closed.

Third Embodiment

Figure 10:
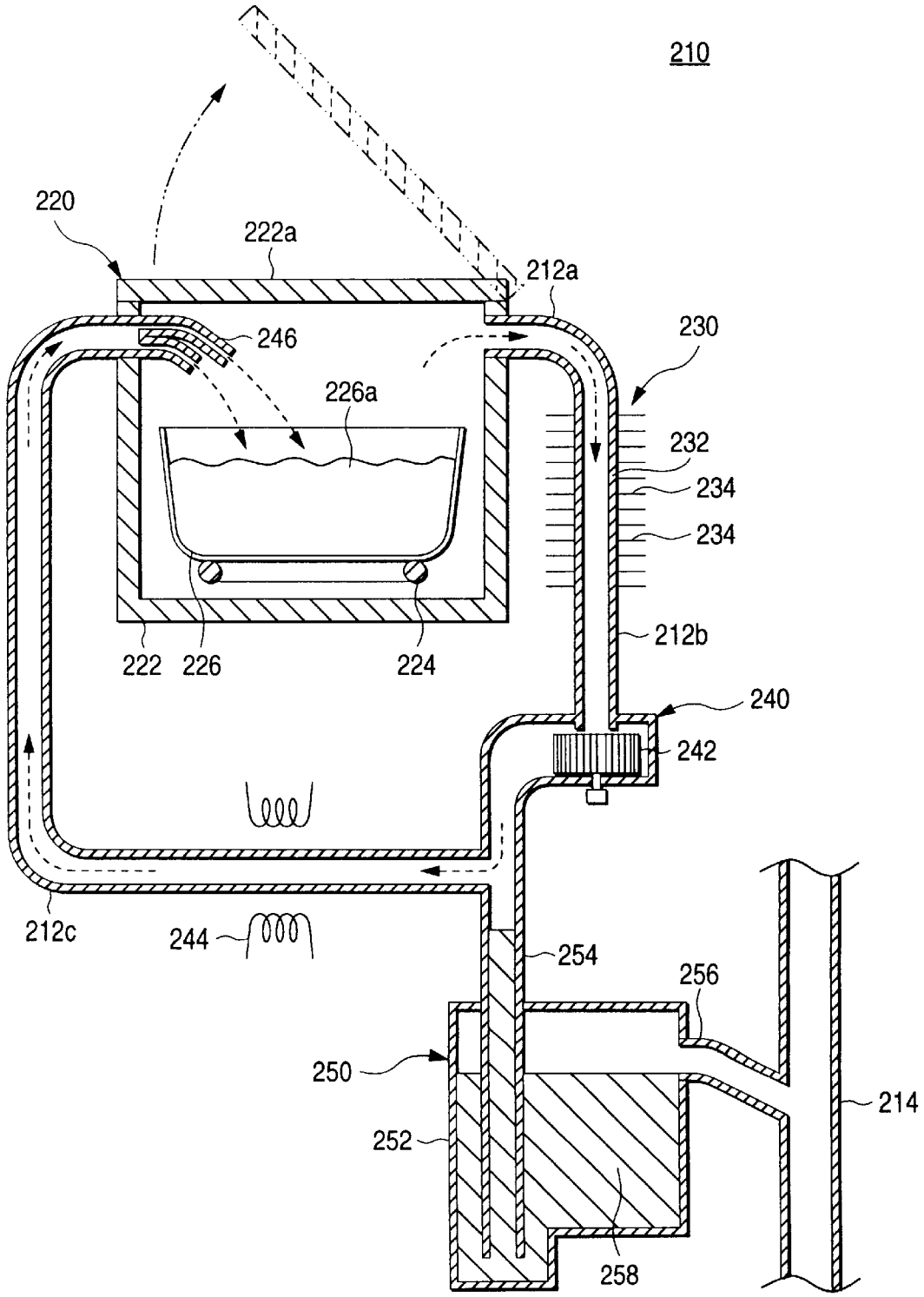
FIG. 10 is an arrangement view showing an outline of an example of the third embodiment of the garbage disposer of the present invention.

Referring to the accompanying drawings, the third preferable embodiment of the present invention will be explained as follows. FIG. 10 is an arrangement view showing an outline of the garbage disposer of the present invention. In FIG. 10, the garbage disposer 210 includes: a heating section 220 for heating garbage; a condensing section 230 for condensing steam generated from garbage; a returning means 240 for forcibly returning air cooled in the condensing section 230 to the heating section 220; and an automatically adjusting drainage means 250 for draining condensed water generated in the condensing section 230 and for automatically adjusting pressure in the garbage disposer 210 at the same time.

The heating section 220 is connected with one end of the condensing section 230 via the communicating passage 212*a*, and the other end of the condensing section 230 is connected with the low pressure side of the returning means 240 via the communicating passage 212*b*. The high pressure side of the returning means 240 is connected with the heating section 220 via the communicating passage 212*c* and the blowing nozzle 246. Due to the above arrangement, air in the garbage disposer 210 is circulated in the heating section 220 and the condensing section 230. Further, the automatically adjusting drainage means 250 is connected with the high pressure side of the returning means 240.

The heating chamber 220 is composed in such a manner that the heater 224 for heating the processing tank is arranged in the bottom portion of the heating chamber 222, which can be tightly closed, having a heat insulating structure. The cover 222*a* is arranged in an upper portion of the heating chamber 222, so that the processing tank 226 charged with garbage 226*a* can be accommodated in the heating chamber 222. In this connection, instead of the heater 224 for heating the processing tank, garbage 226*a* may be heated by means of gas burners or microwaves.

Figure 11:
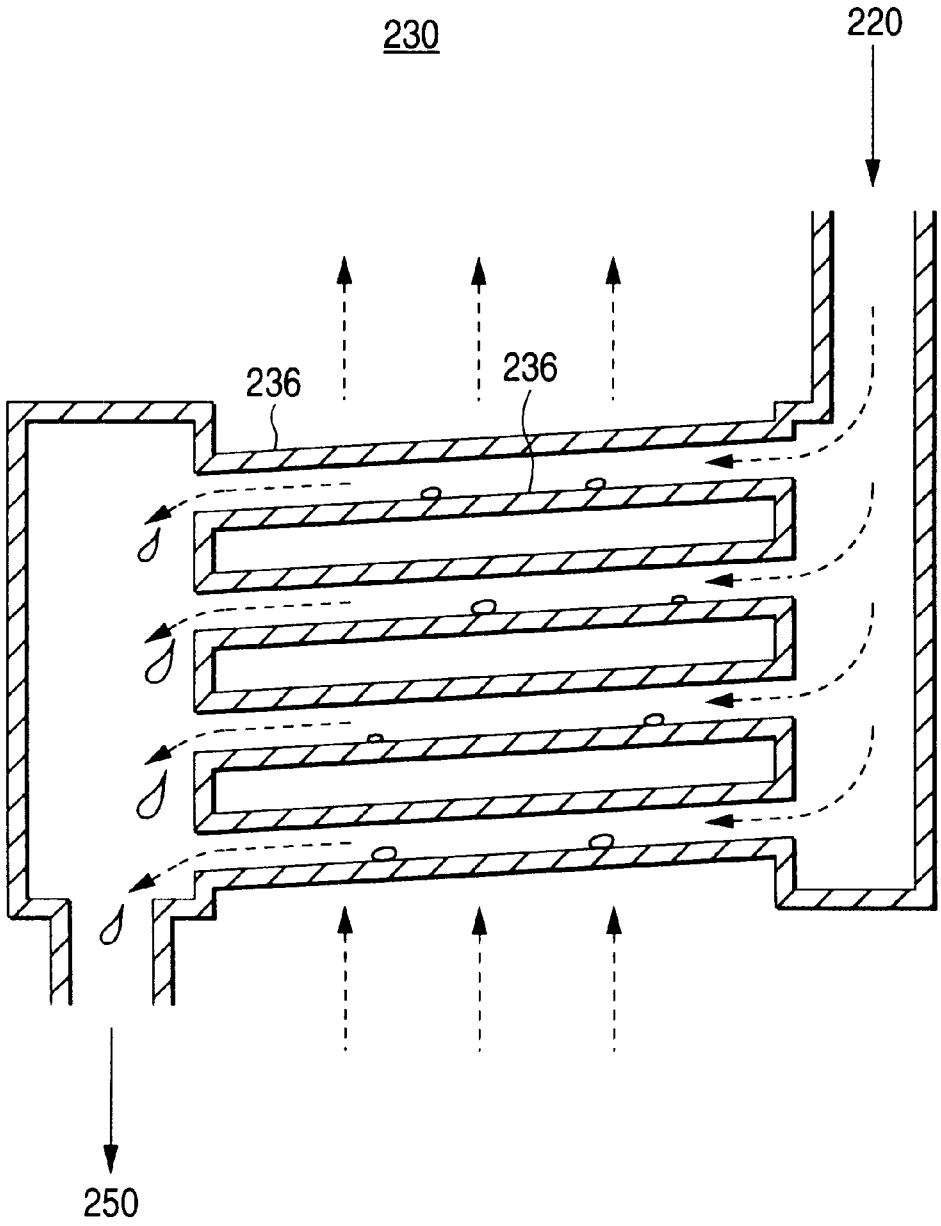
FIG. 11 is an arrangement view showing an outline of the condensing section provided with a plurality of pipes.

The condensing section 230 is composed of a fin tube 232 having a large number of radiating fins 234, 234, . . . As long as wet air containing steam can be cooled and divided into condensed water and dry air in the condensing section 230, any structure for condensation may be adopted. For example, it is possible to use a structure of the condensing section 230 in which a plurality of pipes 236, 236, . . . are obliquely arranged as shown in FIG. 11 and the pipes 236, 236 . . . are cooled by a natural draft force. The cooling structure of the condensing section is not limited to natural cooling, for example, the cooling structure of forced cooling may be adopted, in which a fan is arranged and cooling is conducted forcibly.

The returning means 240 is composed of a circulation fan 242. By the action of the circulation fan 242, a predetermined pressure difference is generated between the communicating passages 212*b* and 212*c*. Due to the pressure difference, gas introduced onto the low pressure side can be discharged onto the high pressure side. In this connection, the high pressure side of the circulation fan 242 is connected with one end of the communicating passage 212*c*, and the other end of the communicating passage 212*c* is connected with the blowing nozzle 246 arranged in the heating chamber 222. The heater 244 for heating gas is arranged in the communicating passage 212*c*. Therefore, it is possible to heat gas passing in the communicating passage 212*c*.

The automatically adjusting drainage means 250 includes: a tank 252 for storing condensed water; a water pipe 254 arranged downward facing the bottom surface of the tank 252; and a drainage pipe 256 arranged on the side of the tank 252. The water pipe 254 is connected with the communicating passage 212*c* and guides condensed water, which has been condensed in the condensing section 230 and discharged from the returning means 240, into the tank 252.

The drainage pipe 256 is arranged at a position located at a predetermined height from the bottom surface of the tank 252 so that a portion of condensed water in the tank 252 can be drained into the drainpipe 214 when a quantity of condensed water staying in the tank 252 has reached a predetermined value.

The maximum pressure on the high pressure side of the circulation fan 242 is determined by a positional head corresponding to the length from the maximum level of water in the tank 252 provided in the automatically adjusting drainage means 250 to the forward end of the water pipe 254. The device is arranged so that this positional head can be smaller than the pressure difference generated by the circulation fan 242.

Next, operation of the garbage disposer 210 shown in FIG. 10 will be explained as follows. First, referring to FIGS. 12A to 12D, a case will be explained in which the garbage disposer 210 is used under the condition that the tank 252 is filled with condensed water to the maximum water level.

Figure 12D:
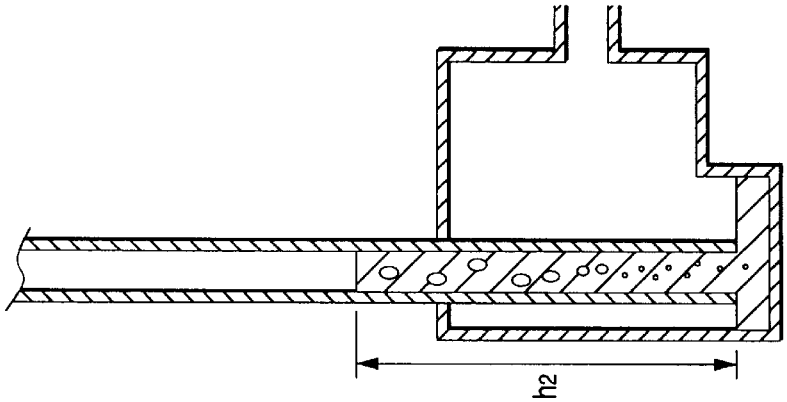
FIGS. 12A to 12D are schematic illustration showing a relation between a pressure in the heating chamber and a change in the level of water in the tank.
Figure 12C:
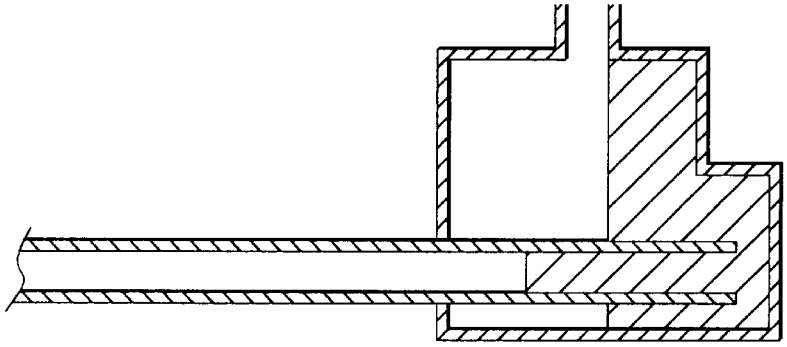
Figure 12B:
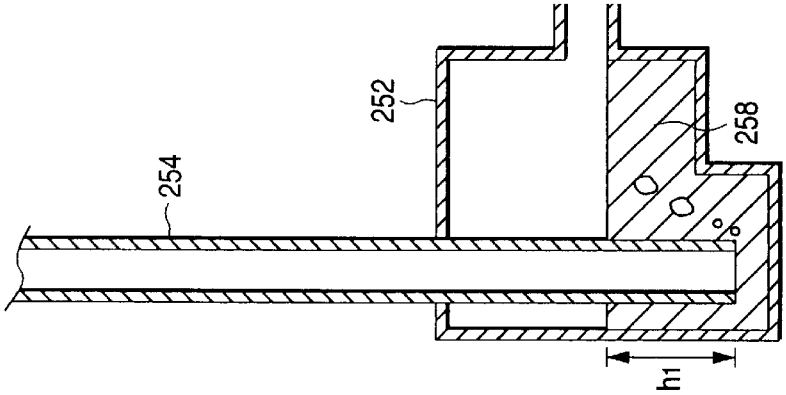
Figure 12A:
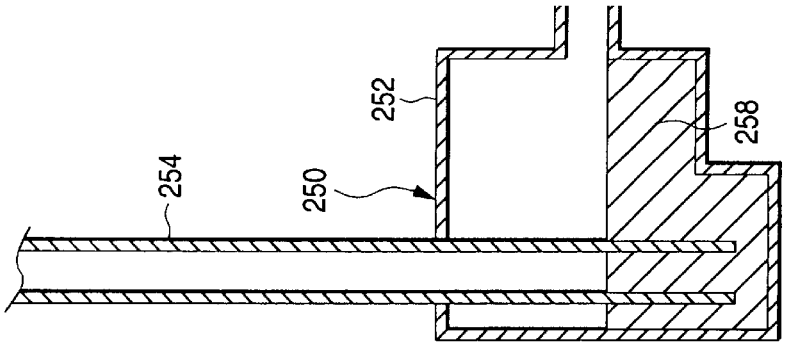

First, the cover 222*a* of the heating chamber 222 is opened, and garbage 226*a* is charged into the processing tank 226 and then the cover 222*a* is closed. At this time, the heating chamber 222 is filled with air, and pressure in the heating chamber 222 is the same as the atmospheric pressure. Therefore, the level of water in the tank 252 of the automatically adjusting drainage means 250 is the same as the level of water in the water pipe 254. This state is illustrated in FIG. 12A.

Next, the heater 224 for heating the processing tank is turned on, so that the processing tank 226 is heated. At the same time, the circulation fan 242 and the heater 244 for heating gas are turned on. When the heater 224 for heating the processing tank is turned on, the processing tank 226 is heated, and steam is generated from garbage 226*a*, and air in the heating chamber 222 is heated and expanded at the same time. Accordingly, pressure in the heating chamber 222 is increased. However, the circulation fan 242 generates a pressure difference. Since the communicating passage 212*c* and water pipe 254 are connected with the high pressure side of the fan 242, pressure of the fan 242 is added to an increase in pressure in the heating chamber 222. The thus obtained pressure is transmitted to condensed water 258 in the water pipe 254, so that the surface of condensed water 258 in the water pipe 254 is pushed down. When the surface of water in the water pipe 254 has reached the forward end of the water pipe 254, a portion of air in the heating chamber 222 is discharged from the forward end of the water pipe 254, and the rising of pressure in the heating chamber 222 is stopped. This state is illustrated in FIG. 12B.

The highest pressure loss is caused by the blowing nozzle 246 in this circulation path. In other words, since pressure loss is seldom caused in the communicating passage 212*a* and the condensing section 230, pressure in the heating chamber 222 is a value obtained when pressure generated by the fan 242 is subtracted from pressure in the water pipe 254.

The heater 224 for heating the processing tank is controlled being turned on and off by a thermistor (not shown) arranged in the bottom portion of the heating chamber 222 so that the temperature in the processing tank 226 can be controlled to a predetermined value. When wrappers are contained in garbage 226*a*, they are decomposed when the temperature in the processing tank 226 exceeds 130° C., and noxious chlorine gas is generated. Therefore, the processing temperature is preferably kept to be not higher than 130° C.

When the circulation fan 242 is turned on, air remaining in the heating chamber 222 is forcibly conveyed to the condensing section 230 together with steam generated from garbage 226*a*. At this time, wet air containing steam is cooled by the radiating fins 234, 234, . . . , and the temperature is decreased to the dew point. Accordingly, steam is condensed to water.

Most of the offensive smell components generated from garbage 226*a* are dissolved into condensed water. Therefore, air in the condensing section 230 is deodorized. Since the heating chamber 222 is shut off from the atmosphere by condensed water staying in the tank 252 of the automatically adjusting drainage means 250, pressure in the circulating path provided from the heating chamber 222 to the communicating path 212*b* is decreased by the condensation of steam.

After condensed water and dried and deodorized air have been discharged from the condensing section 230, it flows in the communicating passage 212*b* and reaches the circulation fan 242. Condensed water passes through the circulation fan 242 and flows and drops into the water pipe 254 as it is. Then, condensed water stays in the tank 252. When the tank 252 is overflowing with condensed water, condensed water passes through the drainage pipe 256 and discharges into the drainpipe 214.

On the other hand, dried and deodorized air is pressurized by the circulation fan 242 and sent to the communicating passage 212*c*. Since pressure on the lower pressure side of the circulation fan 242 is decreased when steam is condensed in the condensing section 230, pressure on the high pressure side of the circulation fan 242 is decreased in accordance with that. Therefore, the condensation of steam proceeds. When pressure on the high pressure side of the circulation fan 242 is decreased to a value lower than the atmospheric pressure, condensed water 258 is sucked up from the tank 252 into the water pipe 254. Accordingly, the level of water in the water pipe 254 is raised. This state is illustrated in FIG. 12C.

After air has been sent into the communicating passage 212*c*, it is heated by the heater 244 for heating gas and sent to the blowing nozzle 246. In this way, heated air is jetted out from the blowing nozzle 246 to garbage 226*a* in the processing tank 226 accommodated in the heating chamber 222.

As described above, under the condition that the heating chamber 222 is kept at a negative pressure, air heated by the heater 244 for heating air is directly jetted out from the nozzle 246 to garbage 226*a*. Further, steam generated from garbage 226*a* is forcibly conveyed to the condensing section 230 together with air in the heating chamber 222. Therefore, the evaporation of steam from garbage 226*a* can be facilitated. When the communicating passage 212*c* is heated, the occurrence of dew condensation in the communicating passage 212*c* can be prevented.

In the beginning of operation of the circulation fan 242, a quantity of condensed water is large. Therefore, pressure in the communicating passage 212*c* continues to decrease, and condensed water in the tank 252 continues to be sucked up into the water pipe 254. Then, pressure in the water pipe 212*c* further decreases. When a forward end portion of the water pipe 254 is exposed from the surface of condensed water 258 remaining in the tank 252, air enters the water pipe 254 from the forward end portion of the water pipe 254, and a decrease in pressure in the communicating passage 212*c* is stopped. This state is illustrated in FIG. 12D.

The reason why air is introduced into the communicating passage 212*c* when pressure in the communicating passage 212*c* is decreased to a value lower than a predetermined value is that it is necessary to prevent condensed water from flowing backward to the heating chamber 222 and also it is necessary to smoothly convey steam generated from garbage 226*a* in the processing tank 226 to the condensing section 230. In order to convey steam to the condensing section 230 smoothly, it is necessary to provide a predetermined quantity of air to be used as a carrier for carrying steam.

Since the automatically adjusting drainage means 250 is arranged, it is possible to automatically adjust the pressure in the communicating passage 212*c* so that the pressure can be kept in a range from the maximum pressure to the minimum pressure determined by the capacity of the tank 252, length of the water pipe 254, cross-sectional area of the water pipe 254 and position at which the water pipe 256 is attached.

As described above, air remaining in the heating chamber 222 circulates in the heating section 220 and the condensing section 230 as a carrier for carrying steam generated from garbage 226*a* until the completion of drying. After water has been completely removed from garbage 226*a*, the heater 224 for heating the processing tank and the heater 244 for heating gas are turned off, and further the circulation fan 242 is turned off. In this way, the drying of garbage 226*a* is completed.

A description will be given to the principle by which the heating chamber 222 is kept at a negative pressure or a slightly positive pressure in the steady state in the garbage disposer of the present invention. Since the high pressure side of the returning means 240 is connected to the automatically adjusting drainage means 250, the maximum pressure and the minimum one on the high pressure side of the returning means 240 are determined by the automatically adjusting drainage means 250. The maximum value of $P_2$ is equal to positional head $h_1$ which is a positional head from the maximum level of condensed water 258 in the tank 252 to the forward end of the water pipe 254, wherein $P_2$ is the pressure on the high pressure side. Positional head $h_1$ is referred to as $h_1$ in this specification hereinafter.

The minimum value of $P_2$ on the high pressure side is equal to $-V_0/a$, wherein $V_0$ is a volume of condensed water 258 stored between the maximum level of condensed water 258 and the forward end of the water pipe 254, and "a" is a cross-section area of the water pipe 254. When this value is substituted by $-h_2$, a range of fluctuation of $P_2$ is expressed by the following formula 1.

$$-h_2 \leqq P_2 \leqq h_1 \qquad \text{[Formula] 1}$$

On the other hand, the following formula 2 is established by $P_1$, $P_2$ and $\Delta P$, wherein $P_1$ is a pressure in the heating chamber 222, that is, $P_1$ is a pressure on the low pressure side of the returning means 240, and $\Delta P$ is a pressure difference generated by the returning means 240.

$$P_2 = P_1 + \Delta P \qquad \text{[Formula] 2}$$

The following formula 3 can be obtained from formula 2.

$$P_1=P_2-\Delta P \quad \text{[Formula] 3}$$

According to formula 1, the maximum value of $P_2$ is restricted by the automatically adjusting drainage means 250 so that the maximum value of $P_2$ can be not higher than $h_1$. According to formula 3, $P_1$ is obtained when $\Delta P$ is subtracted from $P_2$. Therefore, $P_1$ is kept at a value not higher than a slightly positive pressure. When $h_1$ is not higher than $\Delta P$, $P_1$ is equal to the atmospheric pressure or lower than the atmospheric pressure at all times.

For example, in the case where the circulation fan 242, the value of $\Delta P$ of which is 50 mmAq, is used as the returning means 240, the automatically adjusting drainage means 250 is designed so that $h_1$ can be 40 mm. Due to the above, $P_2$ does not become a value not lower than 40 mmAq. Accordingly, $P_1$ can be a negative value at all times. Therefore, it is possible to keep the heating chamber 222 in a depressurized condition.

Figure 13:
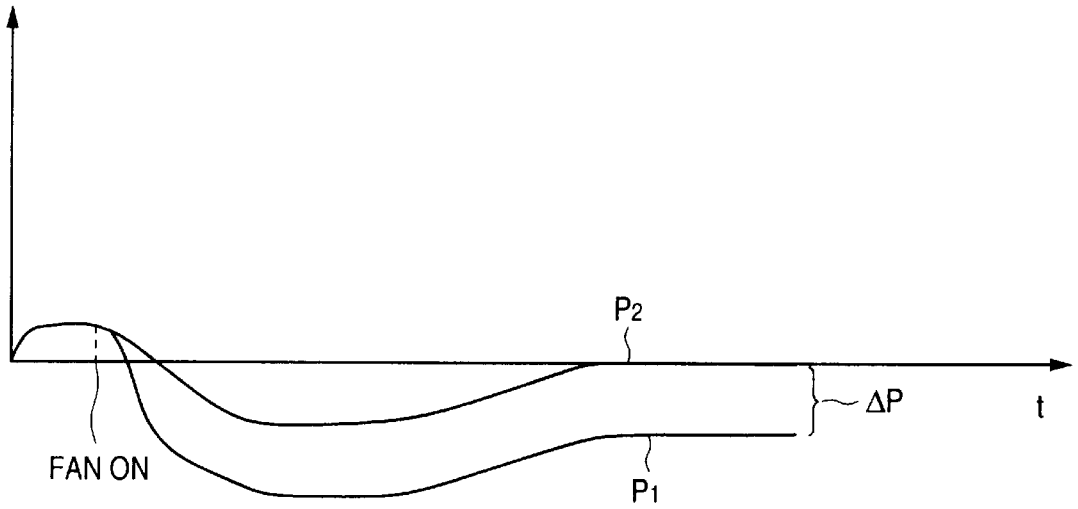
FIG. 13 is a view showing a change with time of pressure in the heating chamber and also showing a change with time of pressure on the high pressure side of the circulation fan.

FIG. 13 is a view showing an example of a change with time of pressure $P_1$ in the heating chamber 222 of the garbage disposer 210 arranged in the manner described above and also showing an example of a change with time of pressure $P_2$ on the high pressure side of the circulation fan 242. At first, garbage 226*a* is charged into the processing tank 226, and the cover 222*a* is closed. At this time, both $P_1$ and $P_2$ are 0 mm Aq, that is, both $P_1$ and $P_2$ are equal to the atmospheric pressure. Under the above condition, the heater 224 for heating the processing tank, the circulation fan 242 and the heater 244 for heating gas are turned on.

When the heater 224 for heating the processing tank is turned on, temperature in the heating chamber 222 is raised, and $P_1$ and $P_2$ are gradually increased. When $P_1$ and $P_2$ are increased to a value corresponding to head $h_1$, the increase of $P_1$ and $P_2$ is saturated.

When the circulation fan 242 is turned on, steam generated from garbage 226*a* is forcibly sent to the condensing section 230 and cooled. Accordingly, both $P_1$ and $P_2$ are suddenly decreased and become negative. A difference between $P_1$ and $P_2$ becomes substantially equal to the pressure difference $\Delta P$ generated by the circulation fan 242.

In accordance with the progress of condensation of steam, $P_2$ continues to decrease. When $P_2$ becomes a value corresponding to head $-h_2$, air enters the water pipe 254 from the forward end portion. Due to the foregoing, the decrease of pressure of $P_1$ and $P_2$ is stopped. When garbage 226*a* is continuously heated while a quantity of heat given to the processing tank by the heater 224 is kept constant, steam generated from garbage 226*a* is gradually reduced, and a quantity of heat taken away by the condensing section 230 is reduced.

As a result, air circulating in the garbage disposer 210 is expanded, and $P_1$ and $P_2$ are gradually increased. Since the upper limit of $P_2$ is restricted by $h_1$ as described above, even if air circulating in the garbage disposer 210 is continuously heated, $P_1$ does not become positive when the pressure difference $\Delta P$ generated by the circulation fan 242 is not less than $h_1$.

Due to the foregoing, in the steady state in which the generation of steam in the heating section 220 and the condensation of steam in the condensing section 230 are continuously proceeding, even if a quantity of heat given by the heating section 220 and a quantity of heat taken away by the condensing section 230 are not balanced with each other, pressure in the heating chamber 222 can be kept at a negative pressure or a slightly positive pressure at all times. When pressure in the heating chamber 222 can be kept at a negative pressure or a slightly positive pressure at all times in the steady state, there is no possibility that the offensive smell and steam leak out from the heating chamber 222 even if the heating chamber 222 is not sealed so completely.

In this connection, in the beginning of drying, the heating chamber 222 is kept at a positive pressure, however, the value of the positive pressure is relatively low, and a period of time in which the heating chamber 222 is kept at a positive pressure is relatively short compared with the accumulated time required for drying garbage 226*a*. Therefore, even if an inexpensive sealing member is used, there is no possibility that the offensive smell and steam leak out.

Next, a case will be described as follows, in which the garbage disposer 210 is used under the condition that condensed water is not staying in the tank 252. Garbage 226*a* is charged into the processing tank 226, and the cover 222*a* is closed. Then, the heater 224 for heating the processing tank, the circulation fan 242 and the heater 244 for heating gas are turned on. Then, steam is generated in the heating chamber 222 and air in the heating chamber 222 is expanded. Expanded air is discharged into the drainpipe 214 via the communicating hole 212*c* from the automatically adjusting drainage means 240. Accordingly, pressure in the heating chamber 222 becomes lower than the atmospheric pressure by $\Delta P$. Accordingly, there is no possibility that the offensive smell and steam leak out from the heating chamber 222.

Steam generated from garbage 226*a* is condensed to water in the condensing section 230. The thus condensed water passes through the returning means 240 and the water pipe 254 and stays in the tank 252. When the level of the forward end portion of the water pipe 254 becomes lower than the level of the surface of condensed water 258 staying in the tank 252, the heating chamber 222 is shut off from the atmosphere.

After that, operation is conducted in the same manner as that in the case where the tank 252 is filled with condensed water from the beginning. That is, while pressure in the heating chamber 222 is being automatically adjusted by the automatically adjusting drainage means 250, garbage 226*a* is being dried. When $h_1$ is not higher than $\Delta P$, $P_1$ can be kept negative in the steady state at all times in the same manner as that described before.

The example of the present invention is explained above. However, it should be noted that the present invention is not limited to the above specific example. Of course, variations may be made by one skilled in the art without departing from the scope of the present invention.

For example, in the above embodiment, simultaneously when the heater 224 for heating the processing tank is turned on, the circulation fan 242 and the heater 244 for heating gas are set in motion. However, after a predetermined period of time has passed from the start of heating conducted by the heater 224 for heating the processing tank, the circulation fan 242 and the heater 244 for heating gas may be set in motion. For example, the temperature, humidity or pressure in the condensing section 230 or the heating chamber 222 is detected, or alternatively the level of water in the tank 252 of the automatically adjusting drainage means 250 is detected, and the circulation fan 242 and the heater 244 for heating gas may be set in motion according to the detected value.

In the above arrangement, when gas flowing in the communicating passage 212*c* is heated by the heater 244 for heating gas, the generation of steam from garbage 226*a* is facilitated, however, the heater 244 for heating gas is not necessarily required. Water contained in garbage 226*a* may be evaporated by a blast of hot air heated only by the heater 254 for heating gas without using the heater 224 for heating the processing tank.

In the above embodiment, the automatically adjusting drainage means 250 includes: the tank 252; the water pipe 254 arranged downward in the tank 252 while the forward end portion of the water pipe 254 faces the bottom surface of the tank 252; and the drainage pipe 256. However, the garbage disposer may have an S-shaped tube including: a downward path in which condensed water flows downward from the condensing section 230; an upward path which rises upward from the downward path; and a drainage flow path in which water flows downward again, connected to the drainpipe. When the above arrangement is adopted, the same effect as that of the above embodiment can be provided.

As described in detail above, according to the garbage disposer described in Aspect 1 of the present invention, gas in the heating section containing a large quantity of steam is made to flow into the condensing section smoothly, and gas cooled in the condensing section containing a small quantity of steam is returned to the heating section. Due to the foregoing, water contained in garbage can be effectively evaporated, and at the same time generated steam can be effectively condensed. Therefore, the drying performance can be enhanced.

According to the garbage disposer described in Aspect 2 of the present invention, it is possible to realize the structure by the communicating passage and the fan.

As described above in detail, according to the garbage disposer described in Aspect 3 of the present invention, when gas containing steam is guided zigzag, steam can be easily contacted with the inside of the plates, so that the cooling efficiency can be enhanced. Further, the structure is so simple that two plates are put on each other. Therefore, it is possible to reduce the equipment cost.

According to the garbage disposer described in Aspect 4 of the present invention, the plates are arranged perpendicularly. Therefore, outside air can be made to flow upward on the outside of the plates by a draft force. Accordingly, the cooling efficiency can be enhanced. When water condensed in the passage is communicated with the lower portion, it is possible to prevent the passage from being blocked by staying water, and at the same time, gas can be made to flow zigzag without being communicated. Therefore, the cooling efficiency can be enhanced.

According to the garbage disposer described in Aspect 5 of the present invention, when pressure in the tightly closed space is decreased and the level of water in the condensed water pool on the drain passage side is decreased to a predetermined shut-up level, air on the drainage passage side is sucked into the tightly closed space. Due to the above arrangement, it is possible to prevent water in the condensing section from rising too high. Therefore, it is possible to prevent the path of gas from being blocked by water in the condensing section.

According to the garbage disposer described in Aspect 6 of the present invention, gas in the heating section containing a large quantity of steam is made to flow into the condensing section smoothly and gas cooled in the condensing section containing a small quantity of steam is returned to the heating section. Due to the foregoing, water contained in garbage can be effectively evaporated, and the thus evaporated steam can be effectively condensed. Accordingly, the drying performance can be enhanced. When gas, the steam content of which has been reduced, is blown against garbage, the evaporation of water can be facilitated.

The garbage disposer of the present invention described in Aspect 7 includes: a returning means for forcibly sending gas, which contains steam generated in the heating chamber, to the condensing section and for forcibly returning gas, which has been discharged from the condensing section, to the heating chamber; and an automatically adjusting drainage means for discharging condensed water outside and for automatically adjusting pressure in the heating chamber at the same time, wherein the automatically adjusting drainage means is communicated with the high pressure side of the returning means. Accordingly, the heating chamber is kept at a slightly positive pressure or a pressure lower than that. Therefore, it is possible to prevent the offensive smell and steam from leaking out.

According to the present invention described in Aspect 8, when a difference between the maximum pressure on the high pressure side of the returning means and the atmospheric pressure is not higher than the pressure difference generated by the returning means, the heating chamber can be kept at a negative pressure in the steady state at all times. Accordingly, even if a quantity of heat given by the heating section and a quantity of heat taken away by the condensing section are not balanced with each other, it is possible to prevent the offensive smell and steam from leaking out from the heating section. Therefore, operation of the garbage disposer can be simplified.

Therefore, for example, when the garbage disposer is used in the kitchen of a common home, it is possible to prevent garbage from decaying and it is also possible to deodorize garbage without deteriorating the environment of the kitchen by preventing a leakage of an offensive smell, a rise in humidity caused by the discharge of steam and a rise in temperature caused by a heat source of the garbage disposer. Accordingly, the garbage disposer of the present invention can provide a very great effect from the industrial viewpoint.

What is claimed is:

1. A garbage disposer comprising:

a heating section for heating garbage;

a condensing section for cooling gas containing steam generated from the garbage, communicated with the heating section;

a drainage path for discharging water condensed in the condensing section to the outside of the garbage disposer; and a returning means for forcibly returning gas, which has been cooled in the condensing section, to the heating means.

2. The garbage disposer according to claim 1, wherein said returning means includes:

a communicating passage for communicating a downstream side of the condensing section with the heating section, and a fan arranged in the communicating passage, by which gas is made to flow from a condensing section side to a heating section side.

3. A garbage disposer comprising:

a heating section for heating garbage;

a condensing section for cooling gas containing steam generated from the garbage, communicated with the heating section; and a drainage path for discharging water condensed in said condensing section to the outside of the garbage disposer, wherein said condensing section is composed of two plates which are connected and sealed at peripheries of the two plates, at least one of the plates having recess portions so that a space is formed between the two plates and so that a plurality of partition walls are provided in the space which allow gas to be guided in a zigzag path through the space and the partition walls.

4. The garbage disposer according to claim 3, wherein said condensing section is arranged so that the two plates can be perpendicularly set and gas can be guided zigzag in the upward and the downward direction between the two plates, and said plurality of partition walls include a first partition wall which only has a lower opening and a second partition wall which has an upper opening and a lower opening, the lower opening of the second partition wall being lower than the lower opening of the first partition wall, the first partition wall and the second partition wall being alternatingly provided to allow gas to be guided in a zigzag path.

5. The garbage disposer according to claim 4, further comprising:

a shut-off drainage section, wherein condensation pool is formed in a path from said condensing section to said water drainage, said path from said condensing section to said water drainage path is shut off by water in the condensation pool when water in the condensation pool exceeds a predetermined shut-up water level, and water exceeding a predetermined drainage level, which is higher than the shut-up water level, is discharged to the water drainage path, and air in the water drainage path is sucked into the condensing section when the pressure in the condensing section is decreased to be lower than the pressure in the drainage path and the level of water in the condensation pool is decreased to the shut-up water level.

6. The garbage disposer according to claim 5, further comprising:

a returning means for forcibly returning gas cooled in the condensing section to the heating section; and a blowing nozzle for blowing gas, which has been returned to the heating section, toward garbage.

7. The garbage disposer according to claim 4, further comprising:

a returning means for forcibly returning gas cooled in the condensing section to the heating section; and a blowing nozzle for blowing gas, which has been returned to the heating section, toward garbage.

8. The garbage disposer according to claim 3, further comprising:

a returning means for forcibly returning gas cooled in the condensing section to the heating section; and a blowing nozzle for blowing gas, which has been returned to the heating section, toward garbage.

9. A garbage disposer comprising:

a heating section for heating garbage;

a condensing section for cooling gas containing steam generated from the garbage, communicated with the heating section;

an automatically adjusting drainage means for draining water condensed in the condensing section and also for automatically adjusting pressure in the heating section; and a returning means for forcibly returning gas cooled in the condensing section to the heating section, wherein the automatically adjusting drainage means is connected to a high pressure side of the returning means.

10. The garbage disposer according to claim 9, wherein a maximum pressure on the high pressure side of the returning means is not higher than a difference in pressure generated by the returning means.

* * * * *